US009559456B2

(12) United States Patent
Harmon et al.

(10) Patent No.: US 9,559,456 B2
(45) Date of Patent: Jan. 31, 2017

(54) MAGNETIC ELECTRICAL CONNECTION SYSTEM FOR AN ELECTRONIC DEVICE

(71) Applicant: Google Technology Holdings LLC, Mountain View, CA (US)

(72) Inventors: Roger W Harmon, Crystal Lake, IL (US); Kenneth W Carlson, Hawthorn Woods, IL (US); Daniel P Rodgers, Arlington Heights, IL (US); Glenn S Schultz, Arlington Heights, IL (US); Frank H Stone, Waukegan, IL (US)

(73) Assignee: Google Technology Holdings LLC, Mountain View, CA (US)

( * ) Notice: Subject to any disclaimer, the term of this patent is extended or adjusted under 35 U.S.C. 154(b) by 0 days.

(21) Appl. No.: 14/205,472

(22) Filed: Mar. 12, 2014

(65) Prior Publication Data

US 2014/0273546 A1 Sep. 18, 2014

Related U.S. Application Data

(60) Provisional application No. 61/787,126, filed on Mar. 15, 2013.

(51) Int. Cl.
*H01R 13/17* (2006.01)
*H01R 13/62* (2006.01)
(Continued)

(52) U.S. Cl.
CPC ..... *H01R 13/6205* (2013.01); *H01R 35/04* (2013.01); *H01R 13/2421* (2013.01); *H01R 24/20* (2013.01)

(58) Field of Classification Search
CPC ..... H01R 13/6205; H01R 11/30; H01R 13/17
(Continued)

(56) References Cited

U.S. PATENT DOCUMENTS 4,211,456 A 7/1980 Sears
4,647,120 A 3/1987 Karabakakis
(Continued)

FOREIGN PATENT DOCUMENTS

DE 19512335 C1 8/1996
WO 2010097733 A1 9/2010
(Continued)

OTHER PUBLICATIONS

International Search Report and Written Opinion for International Patent Application No. PCT/US2014/025949, mailed on Oct. 2, 2014, 16 pages.
(Continued)

*Primary Examiner* — Amy Cohen Johnson
*Assistant Examiner* — Matthew T Dzierzynski
(74) *Attorney, Agent, or Firm* — Brake Hughes Bellermann LLP

(57) ABSTRACT

Electrical connection systems (100) for electronic devices (102) are disclosed. In one embodiment, a male electrical connector (104) includes a male housing portion (138) and at least a first magnet (134*a*) carried by the male housing portion (138). The first magnet (134*a*) includes a curved contact surface (1200) configured to abut with a female electrical receptacle (106). At least a first resilient electrical contact (136*a*) is carried by the male housing portion (138) for making an electrical connection with the female electrical receptacle (106). The first magnet (134*a*) and the first resilient electrical contact (136*a*) are disposed in a parallel configuration along a transverse axis of the male housing portion (138).

34 Claims, 23 Drawing Sheets

(51) Int. Cl.

| | |
|---|---|
| ***H01R 35/04*** | (2006.01) |
| *H01R 11/30* | (2006.01) |
| *H01R 13/24* | (2006.01) |
| *H01R 24/20* | (2011.01) |

(58) Field of Classification Search
USPC ..... 439/39, 38, 950
See application file for complete search history.

(56) References Cited

U.S. PATENT DOCUMENTS

| | | | | |
|---|---|---|---|---|
| 4,719,549 | A | 1/1988 | Apel | |
| 7,252,512 | B2 | 8/2007 | Tai et al. | |
| 7,311,526 | B2 | 12/2007 | Rohrbach et al. | |
| 7,331,793 | B2 | 2/2008 | Hernandez et al. | |
| 7,364,433 | B2 * | 4/2008 | Neidlein | H01R 13/424 439/39 |
| 7,416,414 | B2 | 8/2008 | Bozzone et al. | |
| 7,419,378 | B2 * | 9/2008 | Ha | G01R 1/0466 439/39 |
| 7,497,692 | B2 | 3/2009 | Tai et al. | |
| 7,517,222 | B2 * | 4/2009 | Rohrbach | H01R 13/6205 439/39 |
| 7,625,213 | B1 * | 12/2009 | Tse | H01R 13/6205 439/22 |
| 7,645,143 | B2 * | 1/2010 | Rohrbach | H01R 13/6205 439/218 |
| 7,775,801 | B2 * | 8/2010 | Shiff | H01R 13/6205 439/39 |
| 7,901,216 | B2 * | 3/2011 | Rohrbach | H01R 13/6205 439/39 |
| 8,087,939 | B2 * | 1/2012 | Rohrbach | H01R 13/6205 439/39 |
| 8,177,560 | B2 * | 5/2012 | Rohrbach | H01R 13/6205 439/39 |
| 8,187,006 | B2 * | 5/2012 | Rudisill | H01R 11/30 362/249.06 |
| 8,241,043 | B1 * | 8/2012 | Lin | H01R 13/6205 439/39 |
| 8,435,042 | B2 * | 5/2013 | Rohrbach | H01R 13/6205 439/39 |
| 8,514,042 | B2 * | 8/2013 | Lauder et al. | 335/219 |
| 8,888,500 | B2 * | 11/2014 | Gao et al. | 439/39 |
| 2005/0255719 | A1 * | 11/2005 | Heidlein | H01R 13/6205 439/39 |
| 2007/0161262 | A1 | 7/2007 | Lloyd | |
| 2011/0298575 | A1 * | 12/2011 | Cranganu-Cretu et al. | 336/84 M |
| 2013/0005159 | A1 | 1/2013 | Gao et al. | |
| 2013/0065406 | A1 * | 3/2013 | Rohrbach | H01R 13/6205 439/39 |
| 2013/0273752 | A1 * | 10/2013 | Rudisill | H01R 13/6205 439/39 |
| 2013/0328484 | A1 * | 12/2013 | Villarreal et al. | 315/127 |

FOREIGN PATENT DOCUMENTS

| | | | |
|---|---|---|---|
| WO | 2014/151536 | A2 | 9/2014 |
| WO | 2014151536 | A3 | 9/2014 |

OTHER PUBLICATIONS

Invitation to Pay Additional Fees and Partial Search Report for PCT Application No. PCT/US2014/025949, mailed Jun. 6, 2014, 7 pages.

International Preliminary Report on Patentability from corresponding application PCT/US2014/025949, dated Sep. 24, 2015, 12 pages.

* cited by examiner

MAGNETIC ELECTRICAL CONNECTION SYSTEM FOR AN ELECTRONIC DEVICE

TECHNICAL FIELD

The present disclosure generally relates to electrical connection systems for electronic devices. In particular, the present disclosure relates to magnetic electrical connection systems for electronic devices.

BACKGROUND

Magnetic electrical connectors are used to couple power and/or data transmission cords or cables to a variety of electronic devices, such as notebook computers, cellular phones, tablet computers, and the like. Such connectors facilitate rapid connection and disconnection of these cables from electronic devices. Further, these connectors facilitate disconnection of cables in cases of accidental contact by an individual (for example, unintentionally stepping on a cable) to protect the device from potential damage.

As some electronic devices are designed with increasingly thin housings, such as cellular phones and tablet computers, there is an inclination to design increasingly thin electrical connectors. Thus, for magnetic connectors, there is also an inclination to use increasingly thin magnets. However, electrical connectors that include thin magnets have little resistance to forces applied to the connector or the associated cable. In some cases, the weight of the cable is sufficient to disconnect a magnetic electrical connector from an electronic device.

DETAILED DESCRIPTION OF EXEMPLARY EMBODIMENTS

Figure 1:
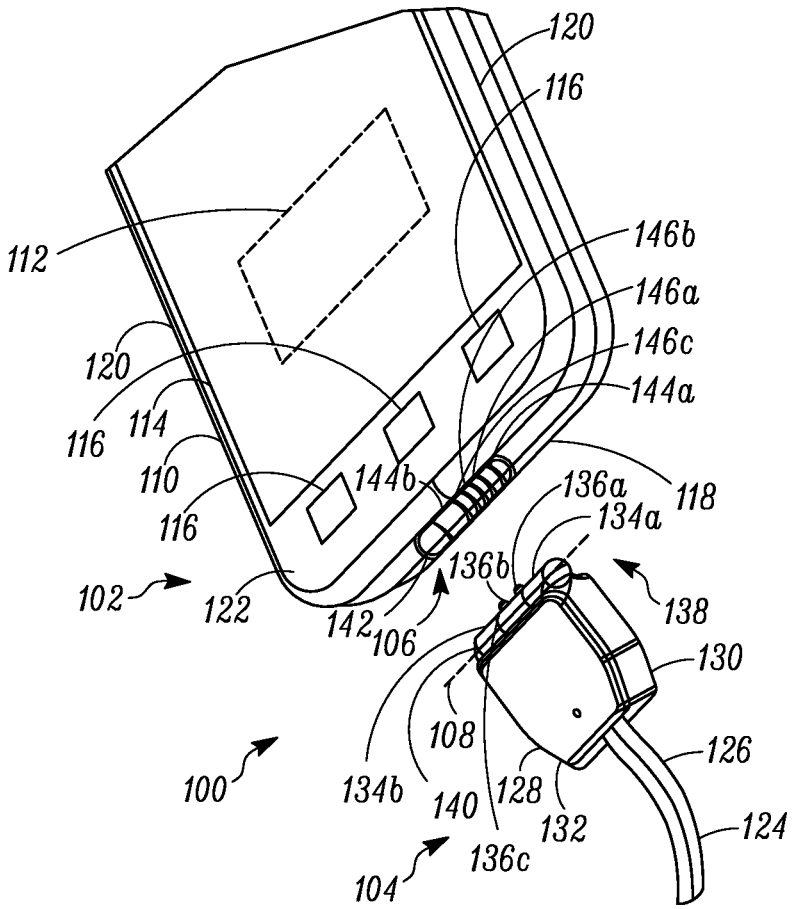
FIG. 1 is a partial perspective view of an example electrical connection system for an electronic device.
Figure 2:
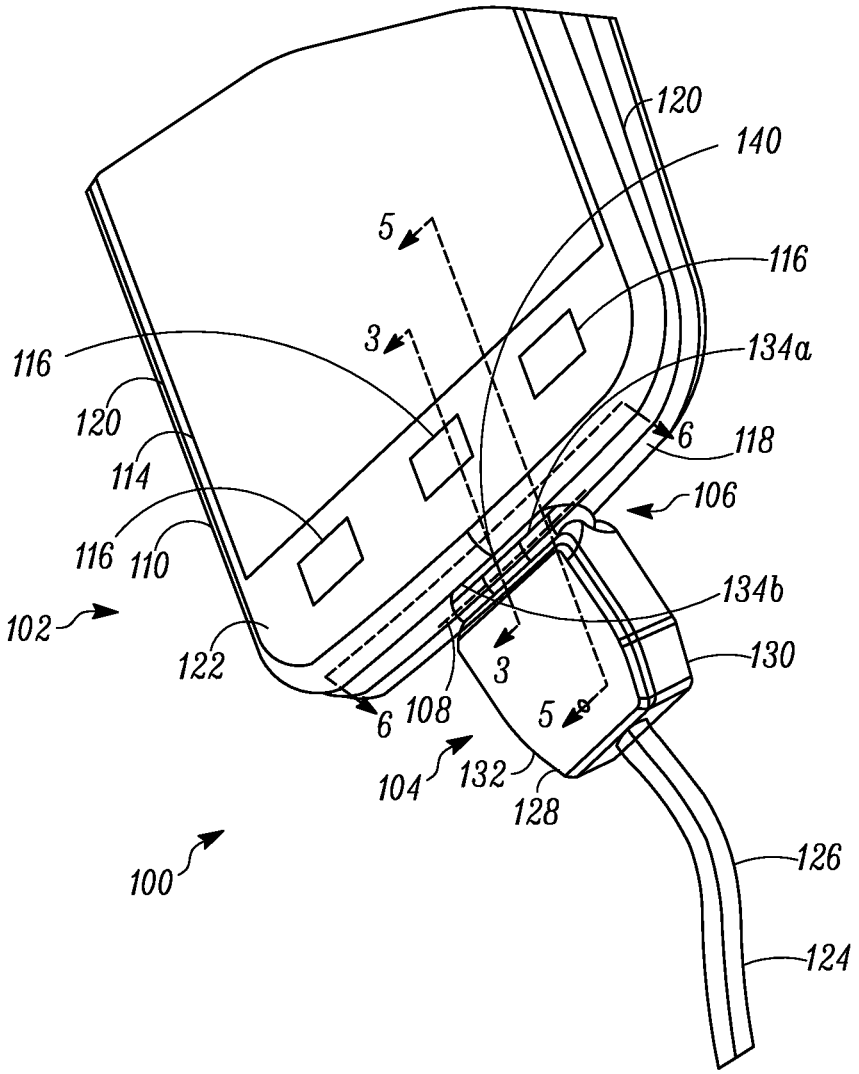
FIG. 2 is a partial perspective view of the electrical connection system of FIG. 1 in which an electrical connector is received by an electrical receptacle.
Figure 3:
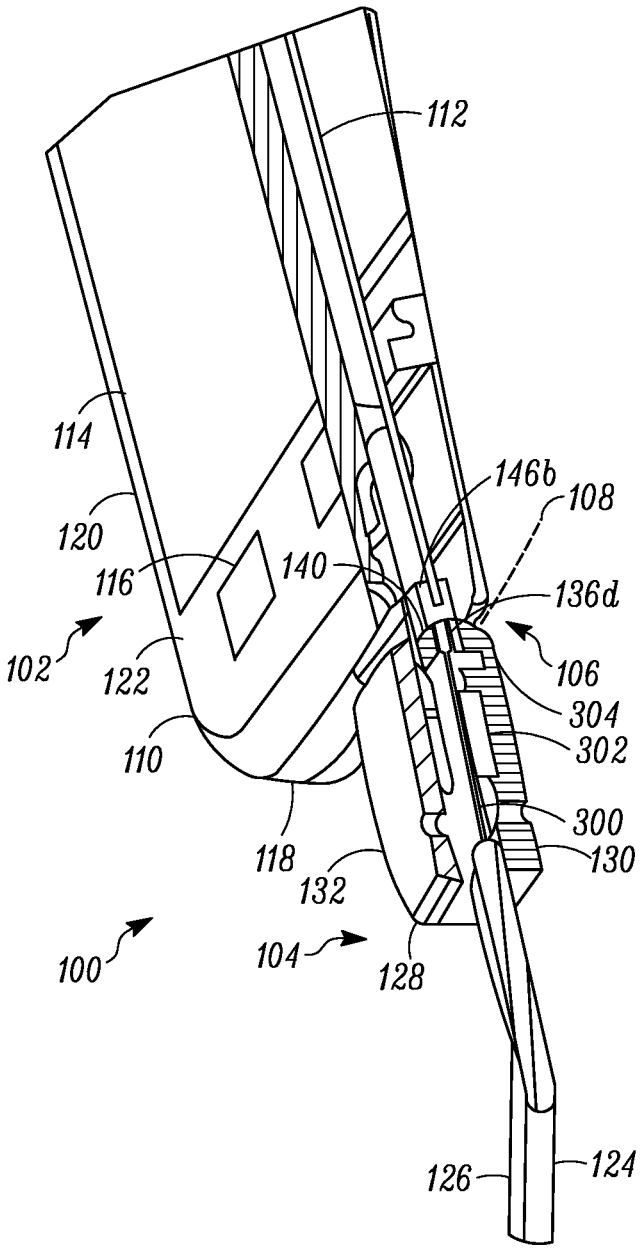
FIG. 3 is a perspective section view of the electrical connection system along line 3-3 of FIG. 2.
Figure 4:
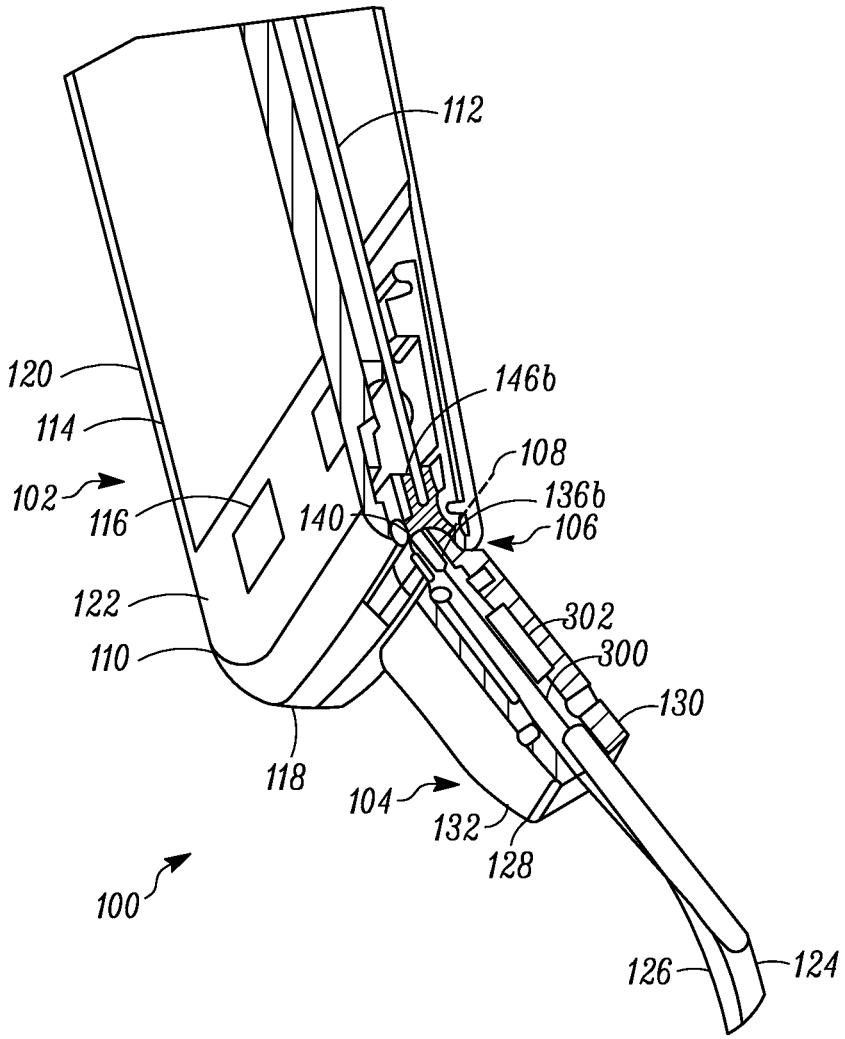
FIG. 4 is a perspective section view of the electrical connection system along line 3-3 of FIG. 2 in which the electrical connector is articulated relative to the electrical receptacle.
Figure 5:
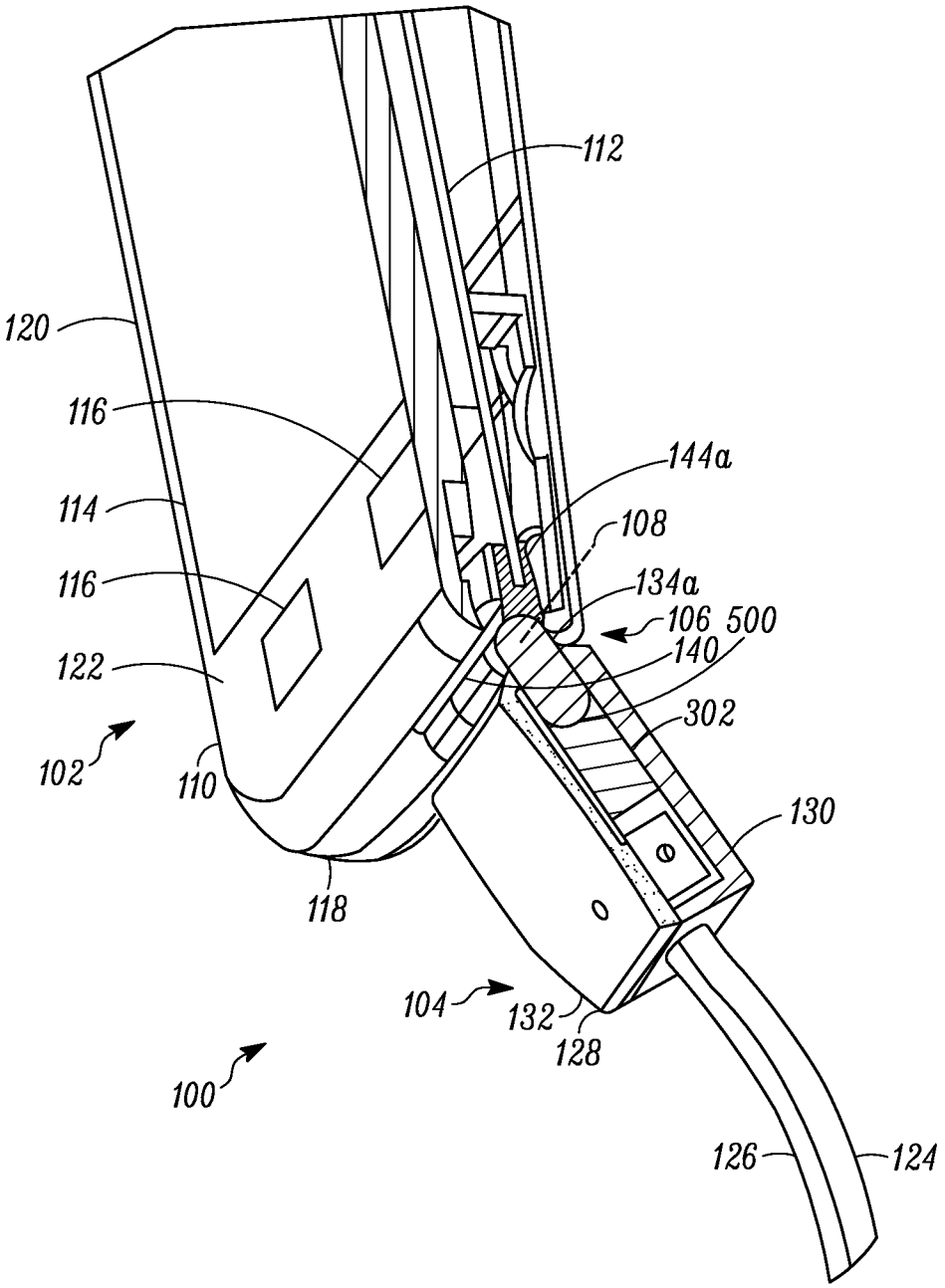
FIG. 5 is a perspective section view of the electrical connection system along line 5-5 of FIG. 2.
Figure 6:
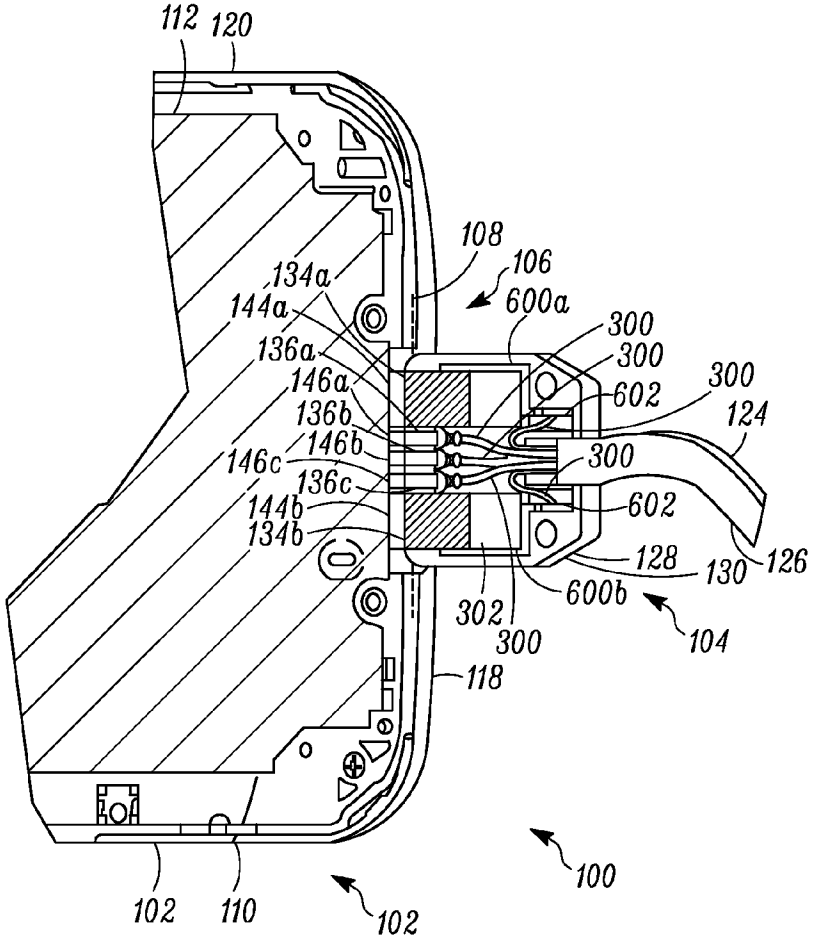
FIG. 6 is a top section view of the electrical connection system along line 6-6 of FIG. 2.
Figure 7:
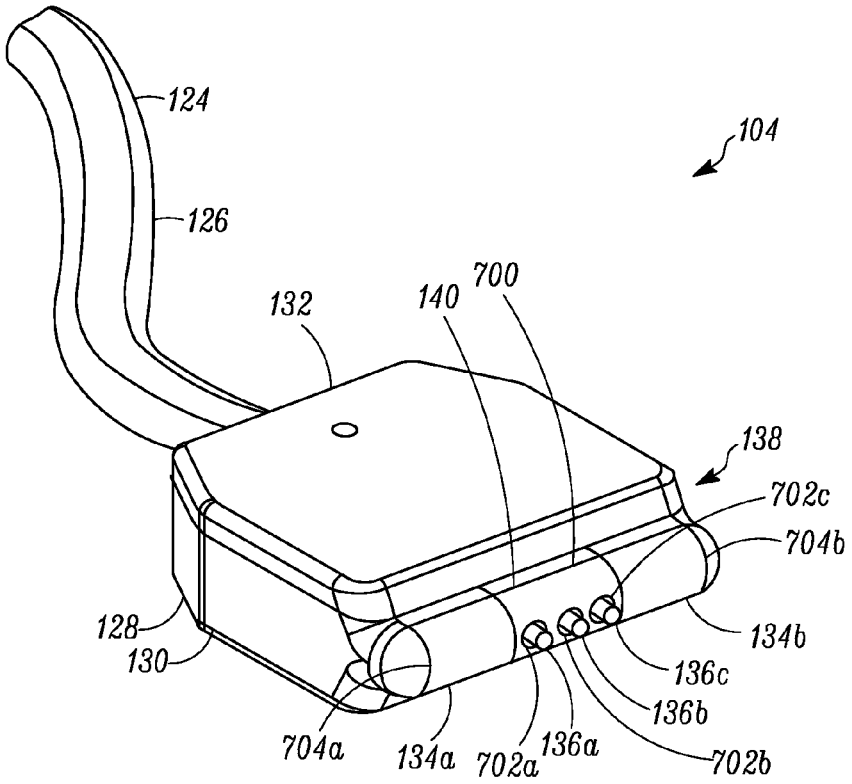
FIG. 7 is a partial perspective view of the electrical connector of the system of FIG. 1.
Figure 8:
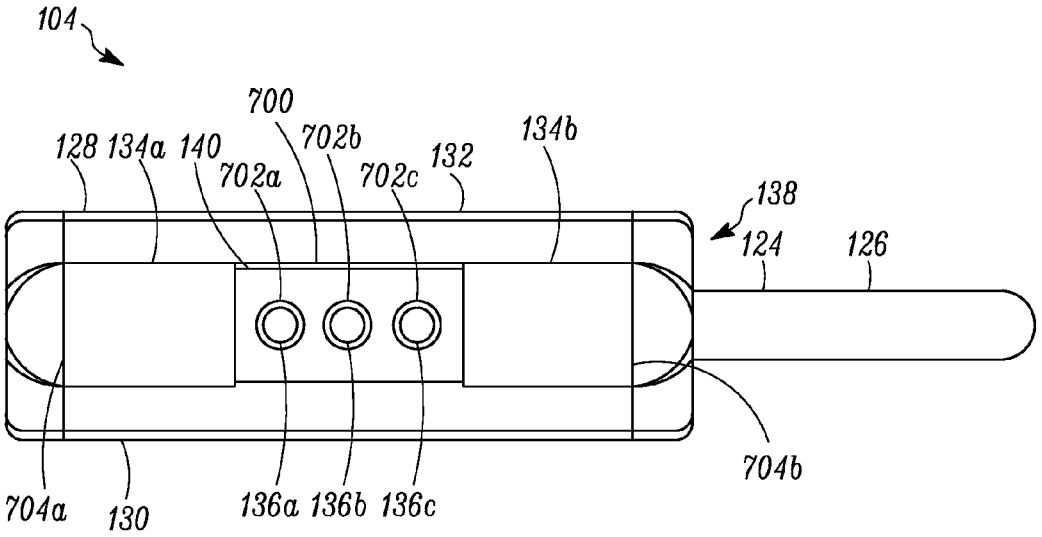
FIG. 8 is a partial front view of the electrical connector of the system of FIG. 1.
Figure 9:
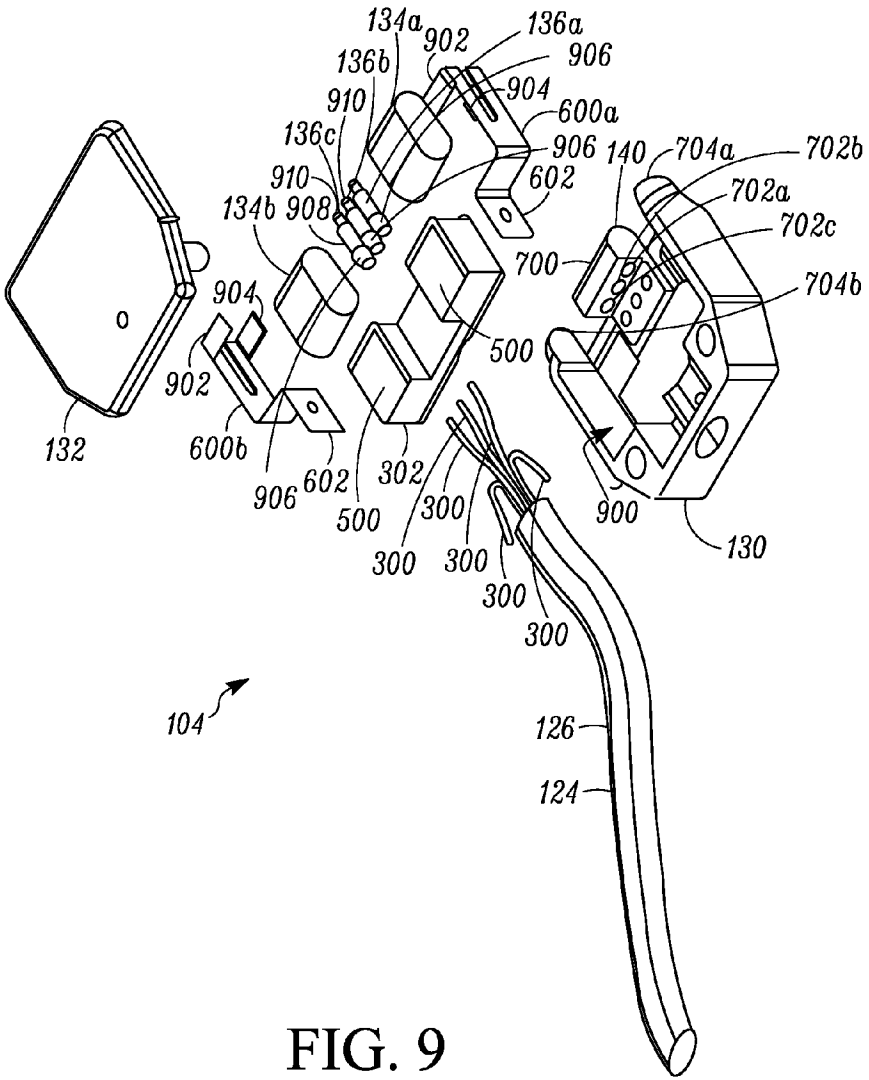
FIG. 9 is a partial exploded view of the electrical connector of the system of FIG. 1.
Figure 10:
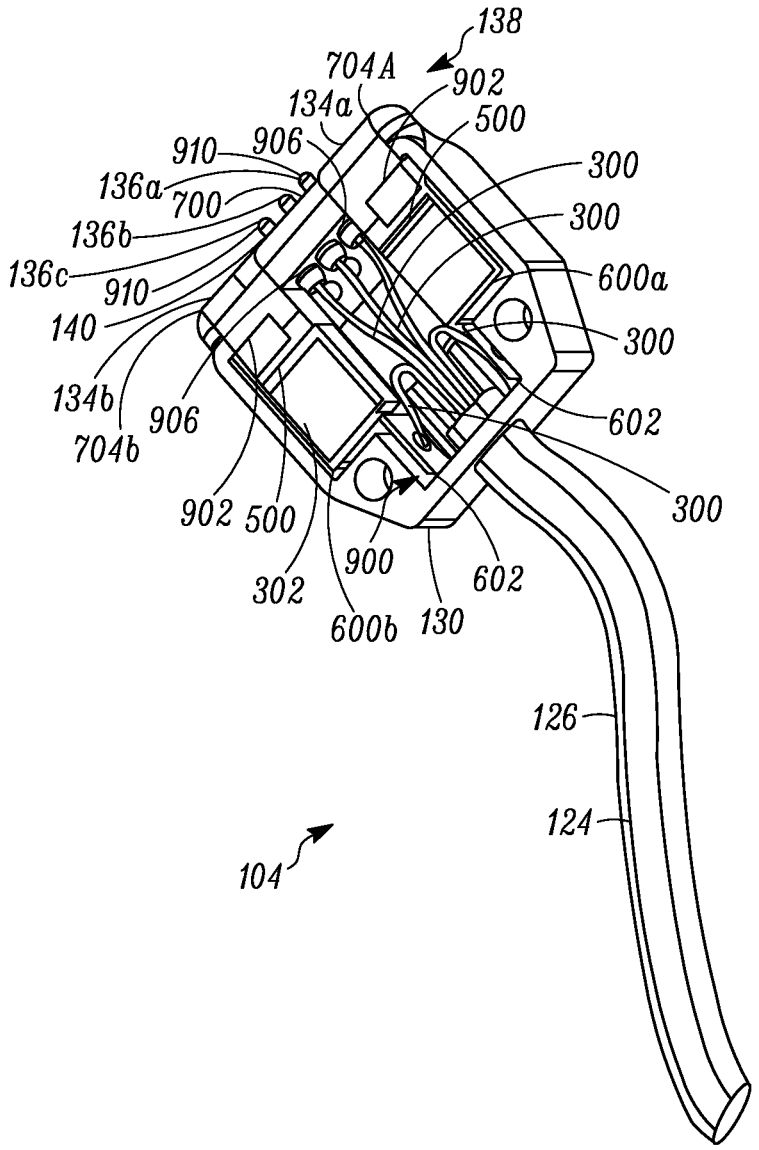
FIG. 10 is a partial perspective view of the electrical connector of the system of FIG. 1 with a connector cover hidden for illustrative purposes.
Figure 11:
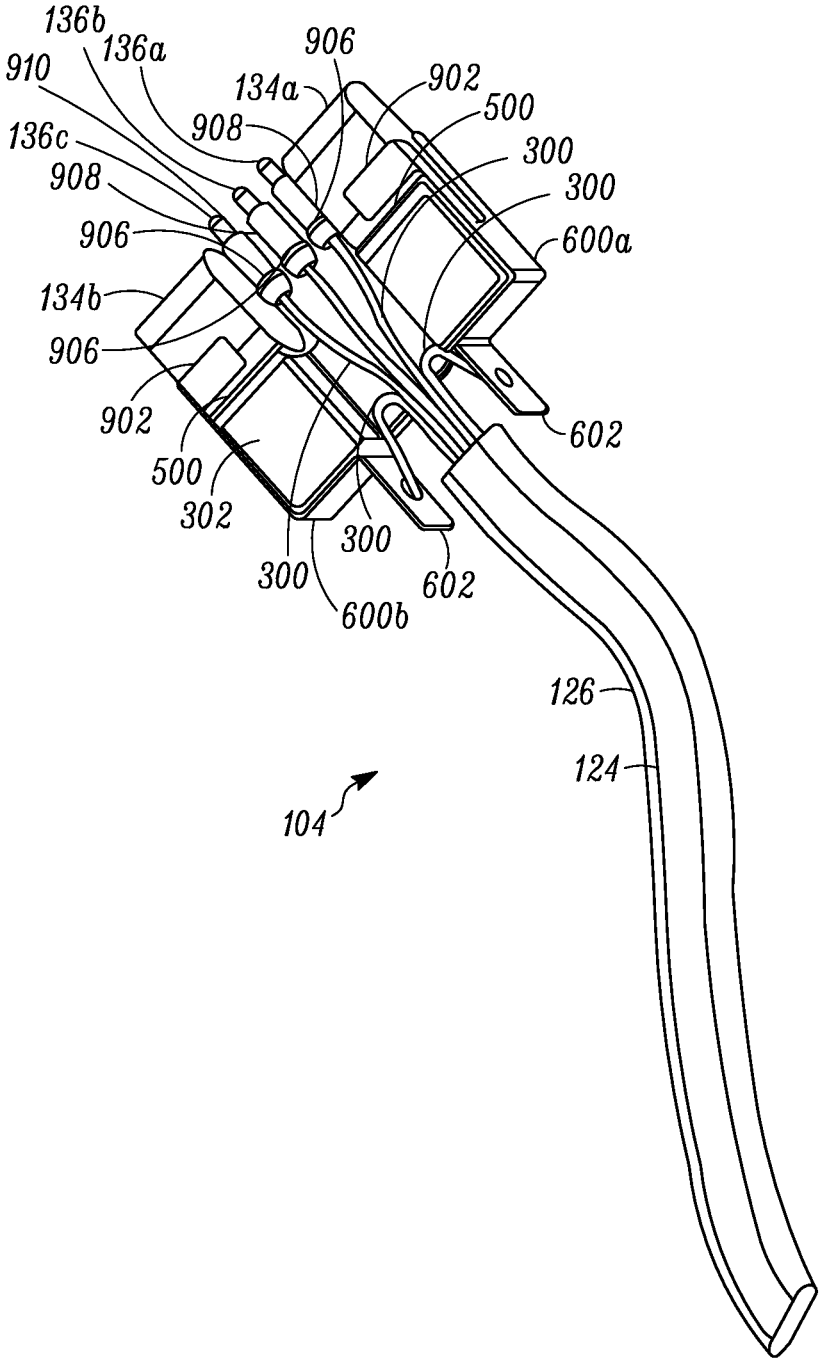
FIG. 11 is a partial perspective view of the electrical connector of the system of FIG. 1 with a connector housing hidden for illustrative purposes.

In a specific embodiment, a male electrical connector includes a male housing portion and at least a first magnet carried by the male housing portion. The first magnet includes a curved contact surface configured to abut with a female electrical receptacle carried by a cellular telephone. At least a first resilient electrical contact is carried by the male housing portion for making an electrical connection with the female electrical receptacle. The first magnet and the first resilient electrical contact are disposed in a parallel configuration along a transverse axis of the male housing portion.

In some exemplary embodiments, the curved contact surface is electrically conductive. In some exemplary embodiments, the curved contact surface is substantially cylindrical. In some exemplary embodiments, the curved contact surface is convex. In some exemplary embodiments, the first resilient electrical contact projects outwardly beyond the curved contact surface. In some exemplary embodiments, the male electrical connector further includes a resilient element carried by the male housing portion and biasing the first resilient electrical contact outwardly with respect to the male housing portion. In some exemplary embodiments, the male electrical connector further includes a shunt carried by the male housing portion and modifying a magnetic field of the first magnet. In some exemplary embodiments, the male electrical connector further includes an insulator carried by the male housing portion and insulating the first magnet from the shunt. In some exemplary embodiments, the male electrical connector further includes a second magnet carried by the male housing portion and having a curved contact surface configured to abut with the female electrical receptacle, and the first resilient electrical contact is disposed between the first magnet and the second magnet. In some exemplary embodiments, the male electrical connector further includes a second resilient electrical contact carried by the male housing portion for making an electrical connection with the female electrical receptacle, and the first resilient electrical contact and the second resilient electrical contact are disposed between the first magnet and the second magnet. In some exemplary embodiments, the male electrical connector further includes a second resilient electrical contact carried by the male housing portion for making an electrical connection with the female electrical receptacle; a third resilient electrical contact carried by the male housing portion for making an electrical connection with the female electrical receptacle; and the first magnet is disposed between the first resilient electrical contact and the second resilient electrical contact, the second resilient electrical contact is disposed between the first magnet and the second magnet, and the second magnet is disposed between the second resilient electrical contact and the third resilient electrical contact. In some exemplary embodiments, the male electrical connector further includes a second magnet carried by the male housing portion and having a curved contact surface configured to abut with the female electrical receptacle; a third magnet carried by the male housing portion and having a curved contact surface configured to abut with the female electrical receptacle; a fourth magnet carried by the male housing portion and having a curved contact surface configured to abut with the female electrical receptacle; and the second magnet is disposed between the first magnet and the first resilient electrical contact, the first resilient electrical contact is disposed between the second magnet and the third magnet, and the third magnet is disposed between the first resilient electrical contact and the fourth magnet. In some exemplary embodiments, the male electrical connector further includes a second resilient electrical contact carried by the male housing portion for making an electrical connection with the female electrical receptacle; a third resilient electrical contact carried by the male housing portion for making an electrical connection with the female electrical receptacle; a fourth resilient electrical contact carried by the male housing portion for making an electrical connection with the female electrical receptacle; and the second resilient electrical contact is disposed between the first resilient electrical contact and the first magnet, the first magnet is disposed between the second resilient electrical contact and the third resilient electrical contact, and the third resilient electrical contact is disposed between the first magnet and the fourth resilient electrical contact. In some exemplary embodiments, the male electrical connector further includes a first insulator extending through the first magnet and mounting the first resilient electrical contact. In some exemplary embodiments, the male electrical connector further includes a second magnet carried by the male housing portion and having a curved contact surface configured to abut with the female electrical receptacle; a second resilient electrical contact carried by the male housing portion for making an electrical connection with the female electrical receptacle; a second insulator extending through the second magnet and mounting the second resilient electrical contact; and a third resilient electrical contact carried by the male housing portion for making an electrical connection with the female electrical receptacle, the third resilient electrical contact being disposed between the first magnet and the second magnet.

In some embodiments, an electrical receptacle includes a female housing portion and at least a first ferrous contact is carried by the female housing portion. The first ferrous contact includes a curved contact surface configured to abut with a male electrical connector. At least a first electrical contact is carried by the female housing portion, and the first electrical contact includes a curved contact surface for making an electrical connection with the male electrical connector. The first ferrous contact and the first electrical contact are disposed in a parallel configuration along a transverse axis of the female housing portion.

In some exemplary embodiments, the first ferrous contact is electrically conductive. In some exemplary embodiments, the curved contact surface of the first ferrous contact is substantially cylindrical. In some exemplary embodiments, the curved contact surface of the first ferrous contact is concave. In some exemplary embodiments, the electrical receptacle further includes a second ferrous contact carried by the female housing portion and having a curved contact surface configured to abut with the male electrical connector, and the first electrical contact is disposed between the first ferrous contact and the second ferrous contact. In some exemplary embodiments, the second ferrous contact is electrically conductive.

In some embodiments, an electrical connection system includes a connector having a male housing portion and at least a first magnet carried by the male housing portion. The first magnet includes a curved contact surface. The system further includes a receptacle configured to engage the connector. The receptacle includes a female housing portion and at least a first ferrous contact carried by the female housing portion. The first ferrous contact includes a curved contact surface configured to abut with the curved contact surface of the first magnet. At least a first resilient electrical contact is carried by one of the male housing portion and the female housing portion. At least a first electrical contact is carried by the other of the male housing portion and the female housing portion. The first electrical contact includes a curved contact surface for making an electrical connection with the first resilient electrical contact. The first magnet and the first resilient electrical contact are disposed in a parallel configuration along a transverse axis of the electrical connection system.

In some exemplary embodiments, the curved contact surface of the first magnet is electrically conductive and the curved contact surface of the first ferrous contact is electrically conductive. In some exemplary embodiments, the curved contact surface of the first magnet and the curved contact surface of the first ferrous contact are substantially cylindrical. In some exemplary embodiments, the electrical connection system further includes a second magnet carried by the male housing portion and comprising a curved contact surface, and the first resilient electrical contact is disposed between the first magnet and the second magnet. In some exemplary embodiments, the male housing portion is articulatable relative to the female housing portion when the connector is engaged with the receptacle.

In some embodiments, an electrical connector includes a male housing portion having a substantially cylindrical contact surface configured to abut with a substantially cylindrical contact surface of a female electrical receptacle. At least a first resilient electrical contact is carried by the male housing portion for making an electrical connection with the female electrical receptacle. At least a first magnet carried by the male housing portion. The first magnet is configured to hold the substantially cylindrical contact surface of the male housing portion interconnected with the substantially cylindrical contact surface of the female electrical receptacle and hold the first resilient electrical contact interconnected with the female electrical receptacle.

In some exemplary embodiments, the electrical connector further includes a second magnet carried by the male housing portion, the second magnet being configured to hold the substantially cylindrical contact surface of the male housing portion interconnected with the substantially cylindrical contact surface of the female electrical receptacle and hold the first resilient electrical contact interconnected with the female electrical receptacle. In some exemplary embodiments, the electrical connector further includes a second resilient electrical contact carried by the male housing portion for making an electrical connection with the female electrical receptacle, and the first resilient electrical contact and the second resilient electrical contact are disposed between the first magnet and the second magnet. In some exemplary embodiments, the first resilient electrical contact projects outwardly beyond the substantially cylindrical contact surface.

In some embodiments, an electronic device includes a device housing, electronic circuitry carried by the device housing, and a receptacle. The receptacle includes a female housing portion coupled to the device housing, at least a first ferrous contact carried by the female housing portion, and the first ferrous contact comprising a curved contact surface configured to abut with a male electrical connector, and at least a first electrical contact carried by the female housing portion and electrically coupled to the electronic circuitry, and the first electrical contact comprising a curved contact surface for making an electrical connection with the male electrical connector.

In some exemplary embodiments, the first ferrous contact is electrically conductive and electrically coupled to the electronic circuitry. In some exemplary embodiments, the curved contact surface of the first ferrous contact has a substantially constant radius. In some exemplary embodiments, the curved contact surface of the first ferrous contact is concave.

Turning now to the drawings, an exemplary embodiment of the presently disclosed electrical connection system is illustrated in FIGS. 1-6. The electrical connection system 100 facilitates transmission of electrical power and/or electrical communication/data signals to and/or from an electronic device 102 (for example, to power or charge the device 102, to transfer media files to the device 102, and the like). The electrical connection system 100 generally includes a male electrical connector 104 that detachably and electrically couples to a female electrical receptacle 106 carried by the electronic device 102 to transmit power and/or data to and/or from the electronic device 102. Generally, the male electrical connector 104 and the female electrical receptacle 106 are magnetically attracted to one another. Further, the male electrical connector 104 and the female electrical receptacle 106 both include curved contact surfaces for abutting each other and facilitating relative articulation about an articulation axis 108 (FIGS. 3 and 4, for example, show different degrees of relative articulation) while maintaining an operative connection. The aspects and details of these components are explained in further detail below.

The electronic device 102 may be any of various types of devices capable of receiving and/or transmitting electrical power and/or electrical communication/data signals, such as a cellular telephone (as illustrated in the figures), a tablet computer, a notebook computer, a personal digital assistant (PDA), a digital media player, a digital camera, a peripheral device (such as a printer, a scanner, a web camera), or the like. In some embodiments and as illustrated in the figures, the electronic device 102 includes a device housing 110 that houses electronic circuitry 112. The electronic circuitry 112 may include or operatively couple to various components that facilitate performing actions via the electronic device 102 (for example, placing telephone calls, browsing the Internet, and the like). In particular, the electronic circuitry 112 may include or operatively couple to a processor, a memory device, communication buses, and the like.

In some embodiments, the device housing 110 mounts a display 114 that is operatively coupled to the electronic circuitry 112. The display 114 receives electronic signals from the electronic circuitry 112 to provide visual information to a device user. In some embodiments, the display 114 transmits electronic signals to the electronic circuitry 112 upon receiving touch and/or gesture inputs from the device user.

In some embodiments, the device housing 110 mounts one or more keys or buttons 116 that are operatively coupled to the electronic circuitry 112. The keys 116 transmit electronic signals to the electronic circuitry 112 upon receiving touch and/or gesture inputs from the device user.

The device housing 110 mounts the female electrical receptacle 106 on an end surface 118 of the housing 110. In other embodiments, the device housing 110 may mount the female electrical receptacle 106 on a different surface, such as a side surface 120, a front surface 122, or the like. The structure of the female electrical receptacle 106 and physical and operative connections between the female electrical receptacle 106 and the remainder of the electronic device 102 are described in further detail below.

Turning now to FIGS. 1-14 and particularly FIGS. 7-11, the male electrical connector 104 includes a flexible cable or cord 124. The cord 124 includes an electrically insulating jacket 126 that carries electrically conductive wires 300 (see, for example, FIGS. 3 and 4). The conductive wires 300 may each include an electrically insulating outer layer (not shown) to facilitate insulation from each other. At distal end (not shown), the cord 124 couples to one or more of various types of electrical connectors, such as a plug for detachably coupling to a power outlet (for example, a standard 120V outlet), a plug for detachably coupling to a data port (for example, a USB port), or the like. At an opposite proximal end, the cord 124 couples to a connector housing 128.

The connector housing 128 includes a base 130 and a cover 132, each of which may include one or more electrically insulating materials, such as polymers and the like. The base 130 and the cover 132 may couple to each other via threaded fasteners (not shown), snap-fit features (not shown), one or more adhesives, combinations thereof, or the like. The base 130 and the cover 132 together define a chamber 900 (see, for example, FIG. 9) for housing various components that facilitate electrical transmissions to and/or from the electronic device 102. In particular, the chamber 900 houses exposed portions of the conductive wires 300. Within the chamber 900, each conductive wire 300 electrically couples to one of a first magnet 134*a*, a second magnet 134*b*, a first resilient electrical contact 136*a*, a second resilient electrical contact 136*b* (shown retracted in FIG. 1 for illustrative purposes), or a third resilient electrical contact 136*c*. The magnets 134*a* and 134*b* and resilient electrical contacts 136*a*, 136*b*, and 136*c* are described in further detail below.

Two of the conductive wires 300 electrically couple to the magnets 134*a* and 134*b* via intermediate electrically conductive elements 600*a* and 600*b*, respectively. The intermediate elements 600*a* and 600*b* may be components plated with brass, copper, or the like. The intermediate elements 600*a* and 600*b* may have a substantially double-L shape (as viewed from above; see FIG. 6). Each intermediate element 600*a* and 600*b* includes a distal legs 602 that may be coupled to one of the conductive wires 300 via, for example, soldering material. Each intermediate element 600*a* and 600*b* also includes an upper proximate leg 902 and a lower proximate leg 904 disposed on opposite sides and providing a pinching electrical contact and connection to one of the magnets 134*a* and 134*b*.

In some embodiments, the chamber 900 of the connector housing 128 further carries a magnetic shunt 302. The magnetic shunt 302 modifies the magnetic fields of the magnets 134*a* and 134*b*. Thus, the shunt 302 increases the attractive force provided by the magnets 134*a* and 134*b*. The shunt 302 may include a proximal surface 500 that abuts the magnets 134*a* and 134*b*. In some embodiments, the proximal surface 500 includes an electrical insulator or an electrically insulating coating to electrically insulate the magnetic shunt 302 from the magnets 134*a* and 134*b*. In some embodiments, the magnetic shunt 302 is electrically connected to one of the magnets 134*a* and 134*b*.

The base 130 of the connector housing 128 further defines a male housing portion 138 that mounts the magnets 134*a* and 134*b* and the resilient electrical contacts 136*a*, 136*b*, and 136*c*. The male housing portion 138 includes a wall 140 that is partially received in the female electrical receptacle 106. An outer surface 700 of the wall 140 (that is, the surface 700 opposite the chamber 900) may have a curved shape to facilitate relative articulation between the male electrical connector 104 and the female electrical receptacle 106. Specifically, the outer surface 700 may have an outwardly curved or convex shape. In some embodiments, the curved surface 700 may have a substantially cylindrical shape (that is, substantially defining at least a portion of a surface of a cylinder). The longitudinal axis of such a cylindrical shape may be aligned with the articulation axis 108 when the male electrical connector 104 is connected to the female electrical receptacle 106.

The wall 140 of the male housing portion 138 defines passageways 702*a*, 702*b*, and 702*c* extending from the chamber 900 and through the outer surface 700. The passageways 702*a*, 702*b*, and 702*c* receive the resilient electrical contacts 136*a*, 136*b*, and 136*c*, respectively. Thus, the resilient electrical contacts 136*a*, 136*b*, and 136*c* extend from the chamber 900, through the passageways 702*a*, 702*b*, and 702*c*, and outwardly beyond the outer surface 700 of the wall 140.

The wall 140 of the male housing portion 138 also defines openings 704*a* and 704*b* that couple the chamber 900 to the outside of the connector housing 128. The openings 704*a* and 704*b* are disposed on opposite sides of the passageways 702*a*, 702*b*, and 702*c*. The openings 704*a* and 704*b* receive the magnets 134*a* and 134*b*. Thus, the magnets 134*a* and 134*b* protrude from the chamber 900 on opposite sides of the resilient electrical contacts 136*a*, 136*b*, and 136*c*. Various features or components may be used to inhibit the magnets 134*a* and 134*b* from falling out of the openings 704*a* and 704*b*, respectively, such as adhesives, threaded fasteners, snap-fit features, friction-fit connections, or the like.

The resilient electrical contacts 136*a*, 136*b*, and 136*c* may take various forms. Referring briefly to FIGS. 3 and 9-11, in some embodiments, each resilient electrical contact 136*a*, 136*b*, and 136*c* includes an enlarged flange 906 that abuts the wall 140 of the male housing portion 138 to secure the resilient electrical contact 136*a*, 136*b*, and 136*c* within the connector housing 128. The flange 906 connects to a housing portion 908 that carries a resilient element 304, such as a compression spring. The resilient element 304 biases a contact portion 910 outwardly relative to the male housing portion 138. The contact portion 910 is configured to abut and make an electrical connection with the female electrical receptacle 106. Each resilient electrical contact 136*a*, 136*b*, and 136*c* may include various components or features to limit the range of motion of the contact portion 910 relative to the housing portion 908 and inhibit the contact portion 910 from detaching from the housing portion 908.

In some embodiments, each resilient electrical contact 136*a*, 136*b*, and 136*c* has a nominal diameter of about 1.5 mm. In some embodiments, the resilient electrical contacts 136*a*, 136*b*, and 136*c* are disposed apart at a pitch of about 1.8 mm (that is, the resilient electrical contacts 136*a*, 136*b*, and 136*c* have a centerline-to-centerline spacing of about 1.8 mm). In some embodiments, the resilient electrical contacts 136*a*, 136*b*, and 136*c* are disposed apart by about 0.3 mm (that is, the resilient electrical contacts 136*a*, 136*b*, and 136*c* have a gap between each other, occupied by the wall 140 of the male housing portion 138, of about 0.3 mm).

Figure 12:
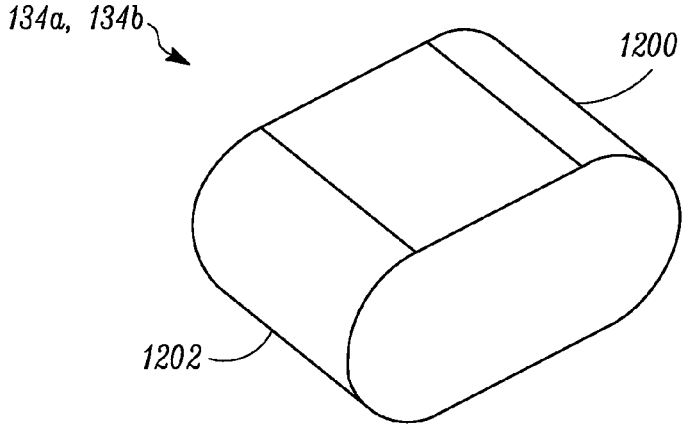
FIG. 12 is a perspective view of a magnet of the electrical connector of the system of FIG. 1.
Figure 13:
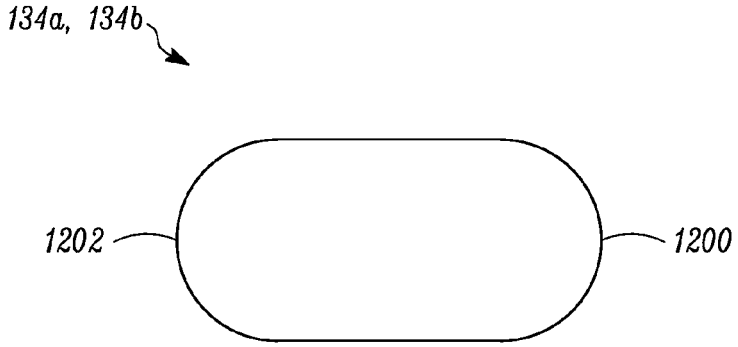
FIG. 13 is a side view of a magnet of the electrical connector of the system of FIG. 1.
Figure 14:
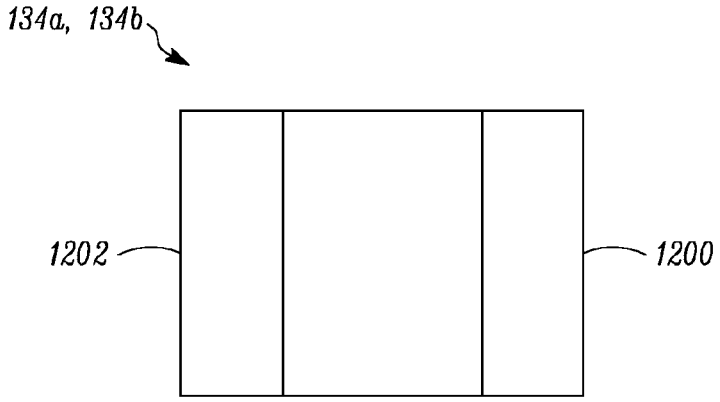
FIG. 14 is a top view of a magnet of the electrical connector of the system of FIG. 1.

Referring briefly to FIGS. 12-14, the magnets 134*a* and 134*b* may be, for example, neodymium permanent magnets or the like. In some embodiments, each magnet 134*a* and 134*b* may have a width (that is, the vertical dimension as shown in FIG. 14) of about 4.35 mm. Each magnet 134*a* and 134*b* has a substantially oval shape as viewed from the side (that is, as viewed along the articulation axis 108). In some embodiments, one of the magnetic poles (that is, the north pole or the south pole) is defined by substantially half of the magnet 134*a* or 134*b* including a proximal surface 1200 (that is, the exposed magnet surface). In such embodiments, the other of the magnetic poles (that is, the south pole or the north pole) is defined by substantially half of the magnet 134*a* or 134*b* including a distal surface 1202 (that is, the enclosed magnet surface). Further, in some embodiments, the proximal surface 1200 of one of the magnets 134*a* or 134*b* may include one of the poles (that is, the north pole or the south pole), and the proximal surface 1200 of the other of the magnets 134*a* or 134*b* may include the opposite pole (that is, the south pole or the north pole).

The proximal surface 1200 of each magnet 134*a* and 134*b* is a curved contact surface configured to abut with the female electrical receptacle 106 and facilitate relative articulation between the male electrical connector 104 and the female electrical receptacle 106. In some embodiments, the curved contact surface 1200 is an outwardly curved or convex shape. In some embodiments, the curved contact surface 1200 may have a substantially cylindrical shape. The longitudinal axis of such a cylindrical shape may be aligned with the articulation axis 108 when the male electrical connector 104 is connected to the female electrical receptacle 106. In some embodiments, the radius of such a cylindrical shape may be about 1.59 mm.

The distal surface 1202 of each magnet 134*a* and 134*b* may be curved as shown in the figures. In some embodiments, the distal surface 1202 may have a different shape. For example, the distal surface 1202 may be a planar surface.

In some embodiments, at least a portion of each magnet 134*a* and 134*b* is plated with an electrically conductive material (such as gold, nickel, alloys, or the like) to facilitate electrical coupling with the female electrical receptacle 106. In some embodiments, such as those in which at least a portion of each magnet 134*a* and 134*b* is plated with an electrically conductive material, the curved contact surface 1200 may have a slightly larger radius than that of the outer surface 700 of the connector wall 140 to facilitate contact between the magnets 134*a* and 134*b* and the female electrical receptacle 106.

Referring again to FIGS. 7-11, in some embodiments the magnets 134*a* and 134*b* are disposed apart from the nearest resilient electrical contact 136*a* or 136*c* by about 0.45 mm. Further, the magnets 134*a* and 134*b* are disposed on opposite sides of the resilient electrical contacts 136*a*, 136*b*, and 136*c* along a transverse axis of the male housing portion 138. Further, the magnets 134*a* and 134*b* and the resilient electrical contacts 136*a*, 136*b*, and 136*c* are disposed in a parallel configuration along the transverse axis. In some embodiments, the transverse axis is aligned with the articulation axis 108 when the male electrical connector 104 is connected to the female electrical receptacle 106. In some embodiments, the transverse axis is an axis that substantially bisects the magnets 134*a* and 134*b* and is substantially perpendicular to a direction in which the resilient electrical contacts 136*a*, 136*b*, and 136*c* are biased. In some of these embodiments, the transverse axis is also aligned with the articulation axis 108 when the male electrical connector 104 is connected to the female electrical receptacle 106.

Turning now to FIGS. 1-6 and 15-18, and particularly FIGS. 15-18, the female electrical receptacle 106 includes a female housing portion 142 that removably receives the male housing portion 700. The female housing portion 142 may include one or more electrically insulating materials, such as polymers and the like. The female housing portion 142 may be coupled to the device housing 110, or the female housing portion 142 may be integrally formed with the device housing 110. The female housing portion 142 also carries components that facilitate connection to the male electrical connector 104.

Figure 15:
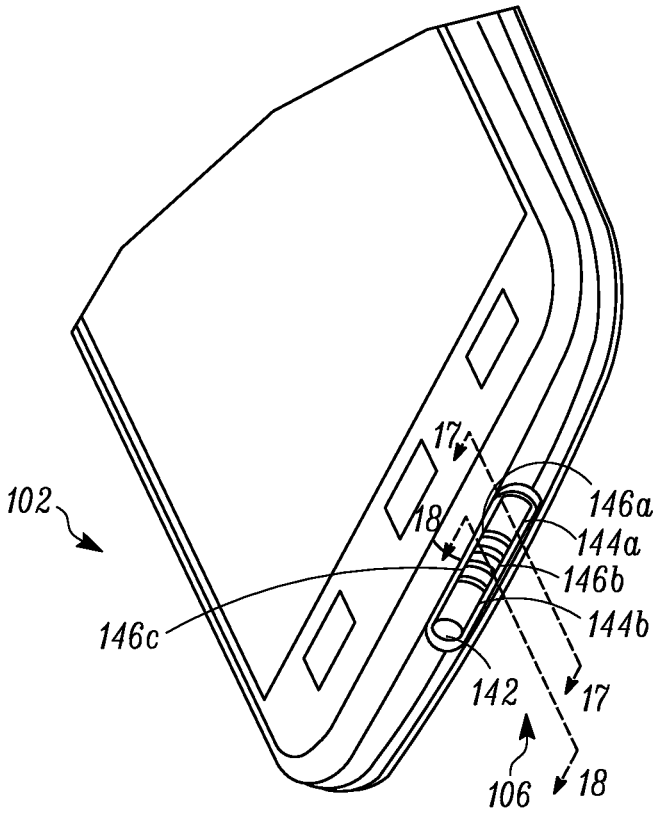
FIG. 15 is a partial perspective view of the electronic device and the electrical receptacle of the system of FIG. 1.
Figure 16:
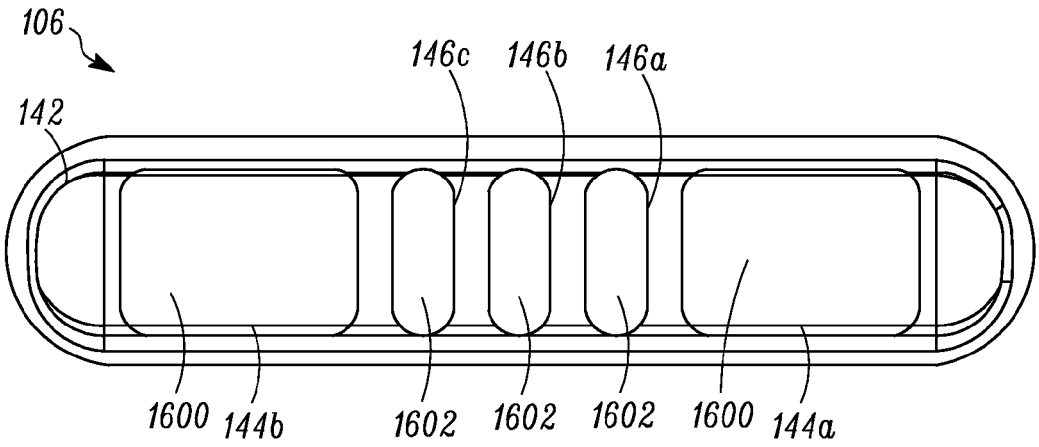
FIG. 16 is a front view of the electrical receptacle of the system of FIG. 1.
Figure 17:
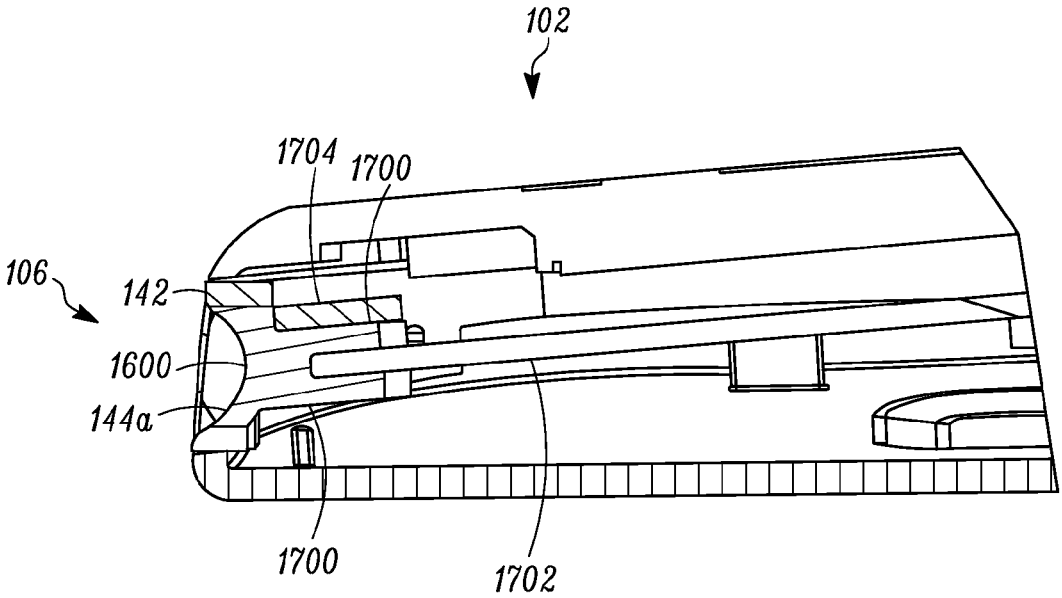
FIG. 17 is a side section view of the electrical receptacle along line 17-17 of FIG. 15.

Referring particularly to FIGS. 15-17, the female housing portion 142 fixedly carries a first ferrous contact 144*a* and a second ferrous contact 144*b*, which each include one or more ferrous materials, such as stainless steel and the like. Thus, the ferrous contacts 144*a* and 144*b* are magnetically attracted by the magnets 134*a* and 134*b* of the male electrical connector 104. Further, the ferrous contacts 144*a* and 144*b* each include a curved contact surface 1600 configured to abut with the magnets 134*a* and 134*b*, respectively. In some embodiments, the curved contact surface 1600 is an inwardly curved or concave shape to facilitate relative articulation between the male electrical connector 104 and the female electrical receptacle 106. In some embodiments, the curved contact surface 1600 may have a substantially cylindrical shape. The longitudinal axis of such a cylindrical shape may be aligned with the articulation axis 108 when the male electrical connector 104 is connected to the female electrical receptacle 106. In some embodiments, such as those in which the curved contact surface 1600 has a substantially cylindrical shape, the curved contact surface 1600 may provide mating abutment with the curved contact surfaces 1200 of the magnets 134*a* and 134*b* (that is, surface contact between the components). In some embodiments, such as those in which the curved contact surface 1600 has a non-cylindrical shape, the curved contact surface 1600 may provide abutting line contact with the curved contact surfaces 1200 of the magnets 134*a* and 134*b*.

In some embodiments, such as those in which the magnets 134*a* and 134*b* are plated with an electrically conductive material, the ferrous contacts 144*a* and 144*b* may be electrically coupled to the electronic circuitry 112 of the electronic device 102 (for example, via conductive legs 1700 extending from each ferrous contact 144*a* and 144*b* and coupled to a circuit board 1702 of the electronic circuitry 112). Thus, electrical power and/or electrical communication/data signals may be transmitted via the magnets 134*a* and 134*b* and the ferrous contacts 144*a* and 144*b*. In some embodiments, the second resilient electrical contact 136*b* acts as a ground and the magnets 134*a* and 134*b* and the first and third resilient electrical contacts 136*a* and 136*c* transmit power and/or electrical communication/data signals.

Figure 18:
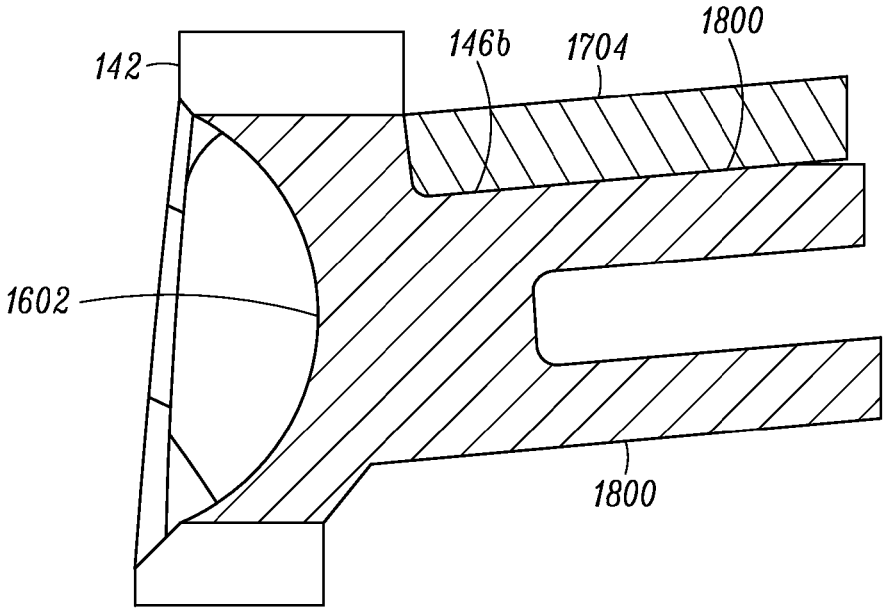
FIG. 18 is a side section view of the electrical receptacle along line 18-18 of FIG. 15.

Referring particularly to FIGS. 15, 16, and 18, the female housing portion 142 also fixedly carries a first electrical contact 146*a*, a second electrical contact 146*b*, and a third electrical contact 146*c*. In some embodiments, each electrical contact 146*a*, 146*b*, and 146*c* include one or more electrically conductive non-ferrous materials, such as copper, brass, and the like. In some embodiments, one or more of the electrical contacts 146*a*, 146*b*, and 146*c* includes one or more electrically conductive ferrous materials. The electrical contacts 146*a*, 146*b*, and 146*c* are configured to abut and displace the resilient electrical contacts 136*a*, 136*b*, and 136*c*, respectively. Further, the electrical contacts 146*a*, 146*b*, and 146*c* are electrically coupled to the electronic circuitry 112 of the electronic device 102 (for example, via conductive legs 1800 extending from each electrical contact 146*a*, 146*b*, and 146*c* and coupled to the circuit board 1702 of the electronic circuitry 112). Thus, electrical power and/or electrical communication/data signals may be transmitted via the resilient electrical contacts 136*a*, 136*b*, and 136*c* and the electrical contacts 146*a*, 146*b*, and 146*c*.

Further, each electrical contact 146*a*, 146*b*, and 146*c* includes a curved contact surface 1602 configured to abut with the resilient electrical contacts 136*a*, 136*b*, and 136*c*, respectively. In some embodiments, the curved contact surface 1602 is an inwardly curved or concave shape to facilitate relative articulation between the male electrical connector 104 and the female electrical receptacle 106. In some embodiments, the curved contact surface 1602 may have a substantially cylindrical shape. The longitudinal axis of such a cylindrical shape may be aligned with the articulation axis 108 when the male electrical connector 104 is connected to the female electrical receptacle 106.

The ferrous contacts 144*a* and 144*b* are disposed on opposite sides of the electrical contacts 146*a*, 146*b*, and 146*c* along a transverse axis of the female housing portion 142. Further, the ferrous contacts 144*a* and 144*b* and the electrical contacts 146*a*, 146*b*, and 146*c* are disposed in a parallel configuration along the transverse axis. In some embodiments, the transverse axis is aligned with the articulation axis 108 when the male electrical connector 104 is connected to the female electrical receptacle 106. In some embodiments, the transverse axis is an axis that substantially bisects the ferrous contacts 144*a* and 144*b*, the electrical contacts 146*a*, 146*b*, and 146*c*, and is substantially perpendicular to a direction in which the electrical contacts 146*a*, 146*b*, and 146*c* displace the resilient electrical contacts 136*a*, 136*b*, and 136*c*. In some of these embodiments, the transverse axis is also aligned with the articulation axis 108 when the male electrical connector 104 is connected to the female electrical receptacle 106.

Referring again briefly to FIGS. 17 and 18, in some embodiments, the female electrical receptacle 106 further includes a magnetic shunt 1704. The magnetic shunt 1704 modifies the magnetic fields of the magnets 134*a* and 134*b* when the magnets 134*a* and 134*b* are near the female electrical receptacle 106. Thus, the shunt 1704 increases the attractive force provided by the magnets 134*a* and 134*b*. The shunt 1704 may overlie the ferrous contacts 144*a* and 144*b* and the electrical contacts 146*a*, 146*b*, and 146*c*. In some embodiments, the magnetic shunt 1704 is electrically insulated from the ferrous contacts 144*a* and 144*b*, the electrical contacts 146*a*, 146*b*, and 146*c*, and the electronic circuitry 112. In some embodiments, the magnetic shunt 1704 electrically couples to one of the ferrous contacts 144*a* and 144*b*, the electrical contacts 146*a*, 146*b*, and 146*c*, or the electronic circuitry 112.

Electrical connection systems according to the present disclosure may have various arrangements and/or numbers of magnets and resilient electrical contacts. For example, FIGS. 1-18 illustrate an embodiment in which the first resilient electrical contact 136*a* is disposed between the first magnet 134*a* and the second resilient electrical contact 136*b*, the second resilient electrical contact 136*b* is disposed between the first resilient electrical contact 136*a* and the third resilient electrical contact 136*c*, and the third resilient electrical contact 136*c* is disposed between the second resilient electrical contact 136*b* and the second magnet 134*b*.

Figure 19:
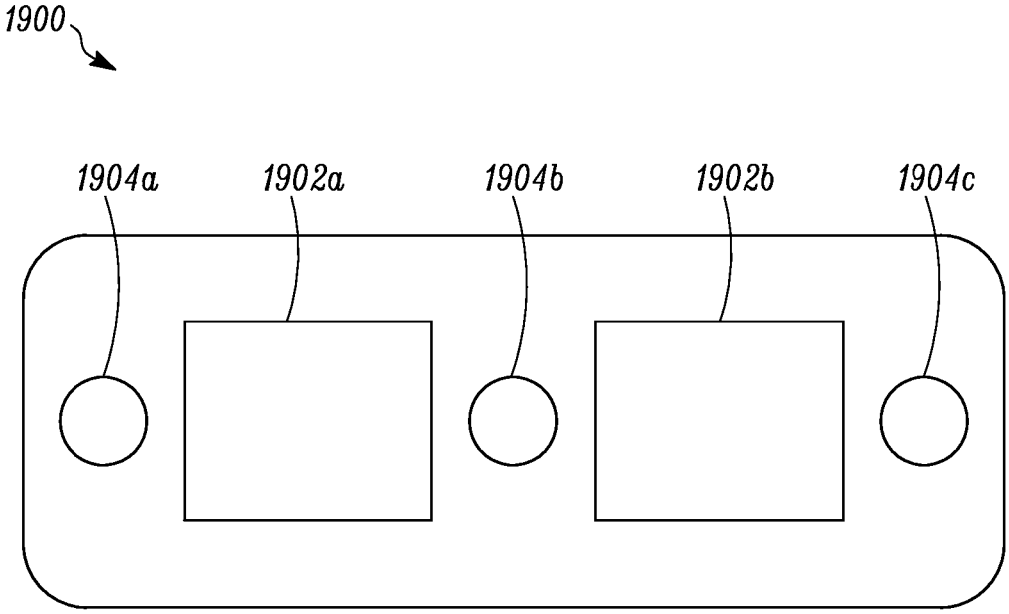
FIG. 19 is a front view of an electrical connector of an example electrical connection system for an electronic device.

As another example, FIG. 19 illustrates an embodiment of a male electrical connector 1900 in which the features and components are substantially as described above. However, a first magnet 1902*a* is disposed between a first resilient electrical contact 1904*a* and a second resilient electrical contact 1904*b*, the second resilient electrical contact 1904*b* is disposed between the first magnet 1902*a* and a second magnet 1902*b*, and the second magnet 1902*b* is disposed between the second resilient electrical contact 1904*b* and a third resilient electrical contact 1904*c*. A female electrical receptacle used with the male electrical connector 1900 may include curved ferrous contacts and curved electrical contacts disposed to abut with the magnets and resilient electrical contacts, respectively.

Figure 20:
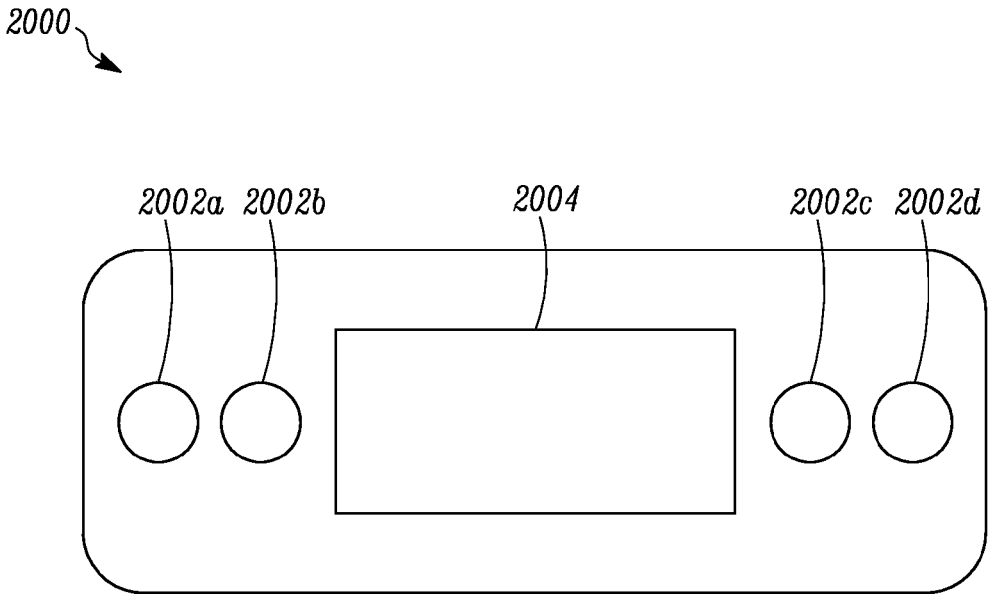
FIG. 20 is a front view of an electrical connector of an example electrical connection system for an electronic device.

As another example, FIG. 20 illustrates an embodiment of a male electrical connector 2000 in which the features and components are substantially as described above. However, a second resilient electrical contact 2002*b* is disposed between a first resilient electrical contact 2002*a* and a first magnet 2004, the first magnet 2004 is disposed between the second resilient electrical contact 2002*b* and a third resilient electrical contact 2002*c*, and the third resilient electrical contact 2002*c* is disposed between the first magnet 2004 and a fourth resilient electrical contact 2002*d*. A female electrical receptacle used with the male electrical connector 2000 may include curved ferrous contacts and curved electrical contacts disposed to abut with the magnets and resilient electrical contacts, respectively.

Figure 21:
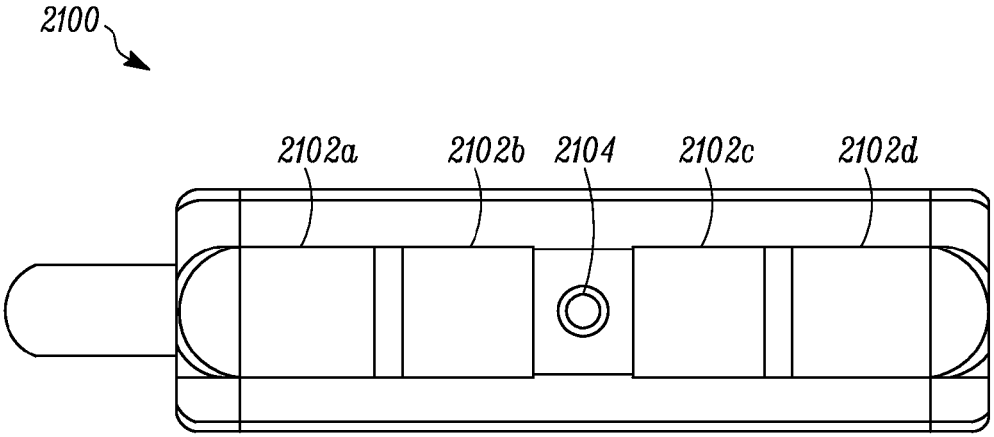
FIG. 21 is a partial front view of an electrical connector of an example electrical connection system for an electronic device.

As another example, FIG. 21 illustrates an embodiment of a male electrical connector 2100 in which the features and components are substantially as described above. However, a second magnet 2102*b* is disposed between a first magnet 2102*a* and a first resilient electrical contact 2104, the first resilient electrical contact 2104 is disposed between the second magnet 2102*b* and a third magnet 2102*c*, and the third magnet 2102*c* is disposed between the first resilient electrical contact 2104 and a fourth magnet 2102*d*. A female electrical receptacle used with the male electrical connector 2100 may include curved ferrous contacts and curved electrical contacts disposed to abut with the magnets and resilient electrical contacts, respectively.

Figure 22:
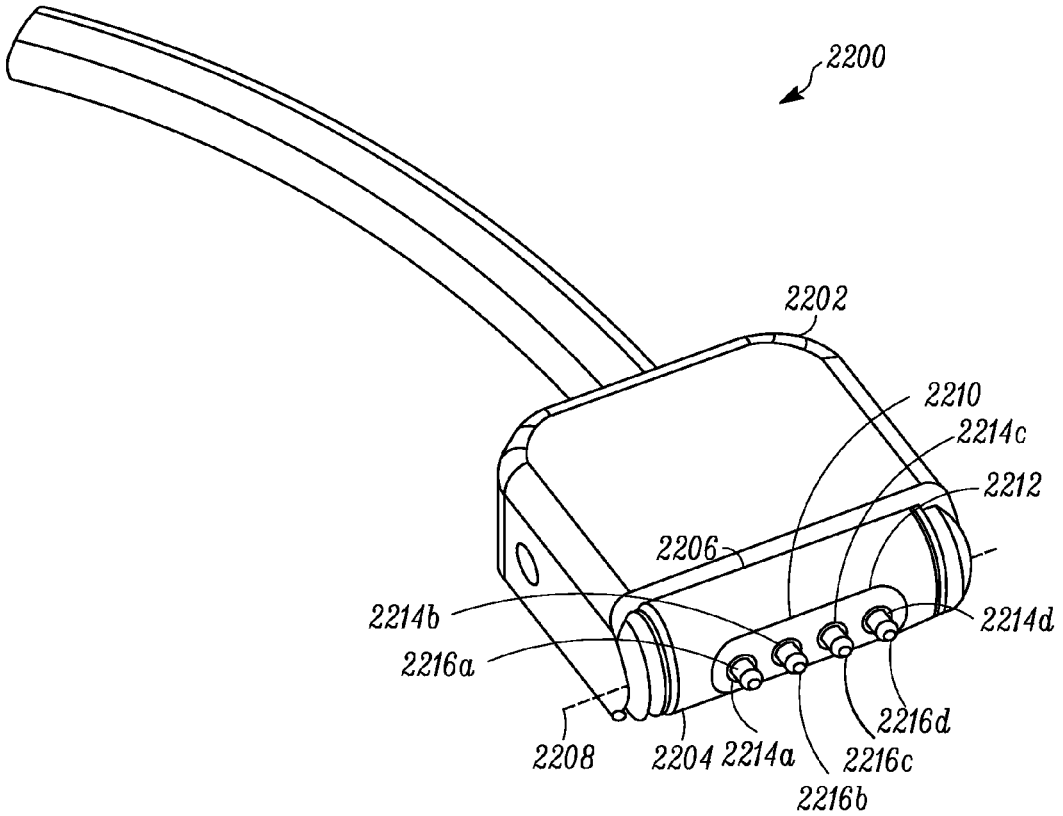
FIG. 22 is a partial perspective view of an electrical connector of an example electrical connection system for an electronic device.
Figure 23:
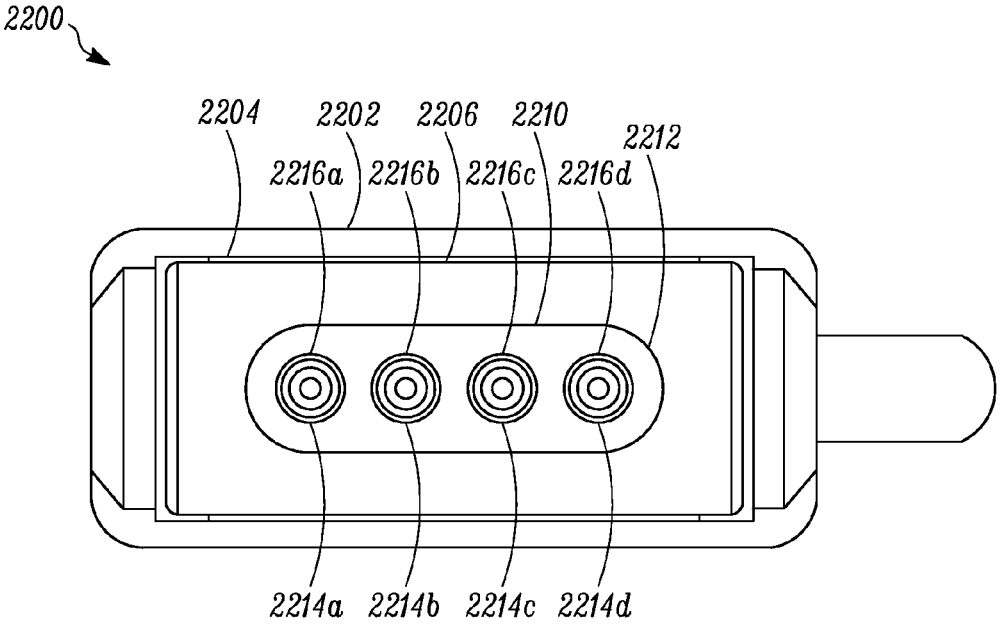
FIG. 23 is a partial front view of the electrical connector of the system of FIG. 22.

FIGS. 22 and 23 illustrate another exemplary embodiment of a male electrical connector 2200 of the presently disclosed electrical connection system. The features and components of the electrical connector 2200 are similar to those described above. However, the electrical connector 2200 includes a connector housing 2202 that mounts a single magnet 2204. The magnet 2204 may be substantially as described above. For example, the magnet 2204 may have a substantially oval shape as viewed from the side and may include an electrically conductive curved contact surface 2206. The magnet 2204 also differs from those described above in several manners. First, the magnet 2204 may be larger than those described above. In particular, in some embodiments, the magnet 2204 has a width in the direction of the articulation axis 2208 of about 10.8 mm and a curved contact surface 2206 radius of about 2.38 mm. Second, the magnet 2204 includes a passageway 2210 extending therethrough (for example, in a radial direction relative to the curved contact surface 2206 of the magnet 2204) that fixedly carries an electrical insulator 2212 (which may comprise one or more polymers or the like). The passageway 2210 and the insulator 2212 may have various shapes as viewed from the front (that is, as viewed in FIG. 23), such as oval shapes and the like. The insulator 2212 in turn defines passageways 2214*a*, 2214*b*, 2214*c*, and 2214*d* that receive a first resilient electrical contact 2216*a*, a second resilient electrical contact 2216*b*, a third resilient electrical contact 2216*c*, and a fourth resilient electrical contact 2216*d*, respectively. The resilient electrical contacts 2216*a*, 2216*b*, 2216*c*, and 2216*d* are substantially as described above. A female electrical receptacle used with the male electrical receptacle 2200 may include curved ferrous contacts and curved electrical contacts disposed to abut with the magnet 2204 and resilient electrical contacts 2216*a*, 2216*b*, 2216*c*, and 2216*d*, respectively. The ferrous contacts may be disposed only to the side of the electrical contacts along the articulation axis 2208 (that is, not above and below the electrical contacts) such that the resilient electrical contacts 2216*a*, 2216*b*, 2216*c*, and 2216*d* do not contact the ferrous contacts when the electrical connector 2200 articulates about the axis 2208.

Figure 24:
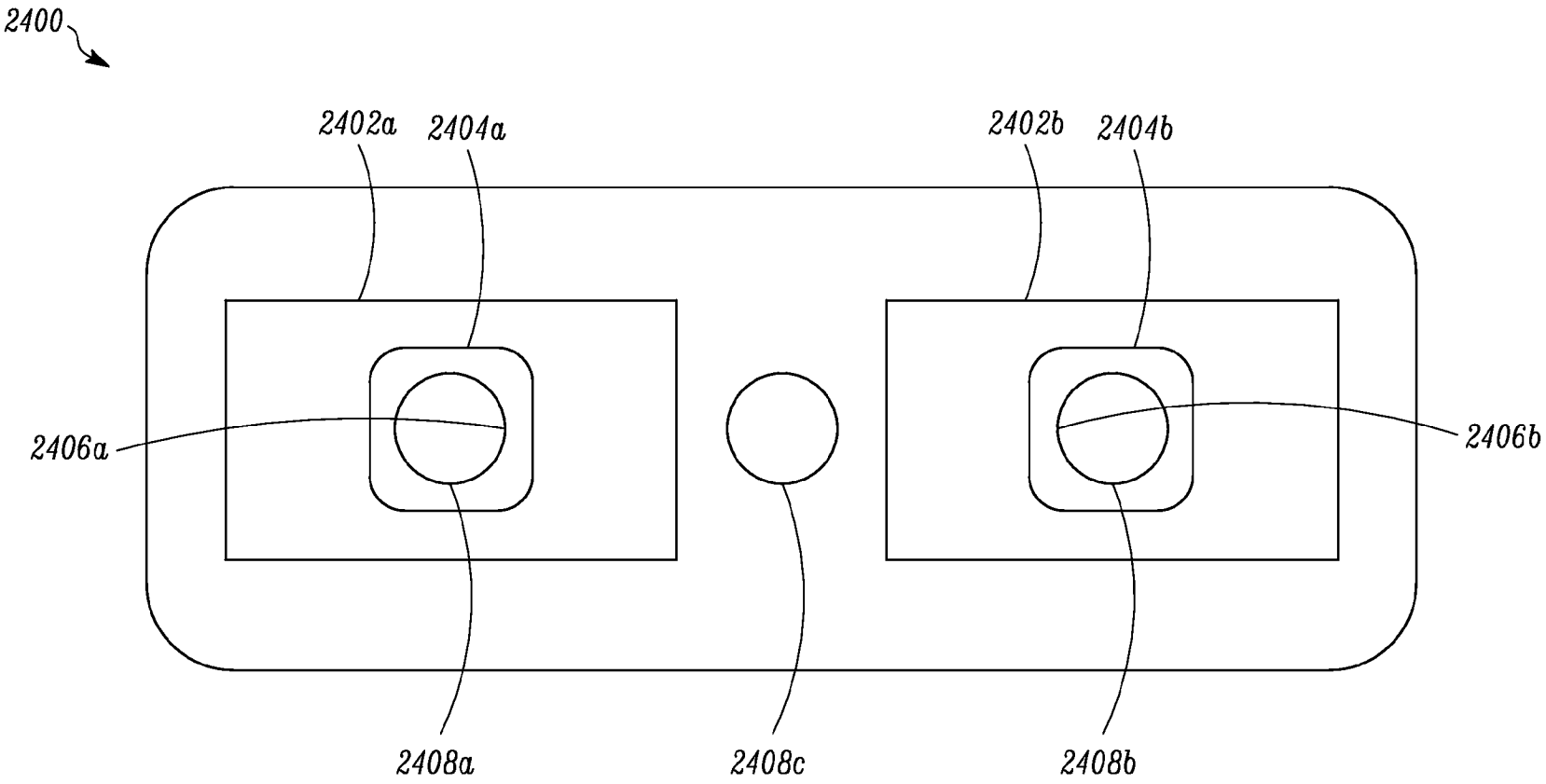
FIG. 24 is a front view of an electrical connector of an example electrical connection system for an electronic device.
Figure 25:
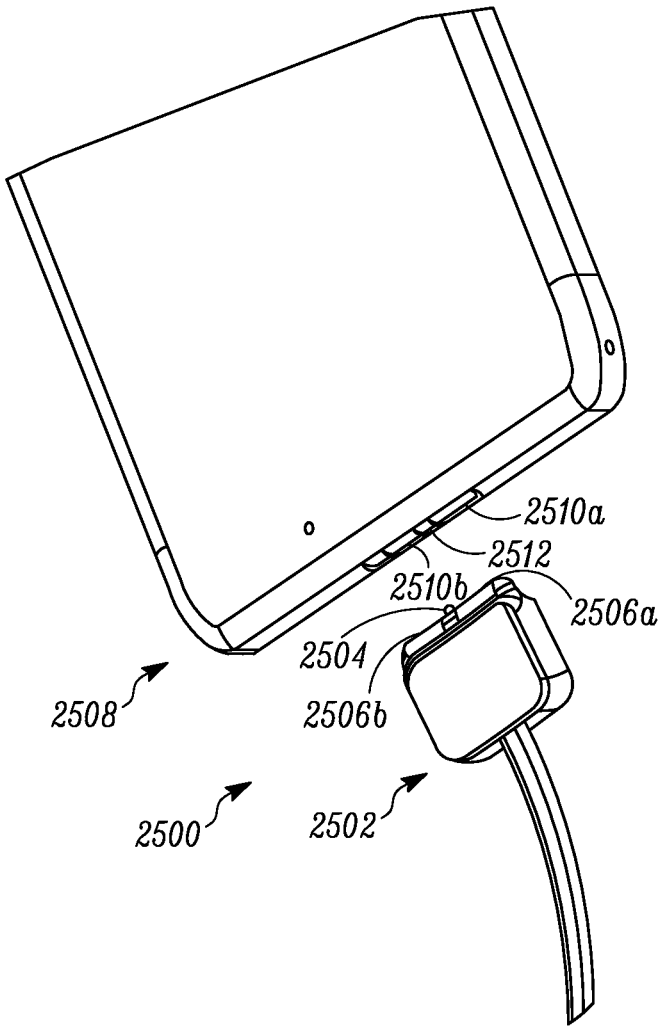
FIG. 25 is a partial perspective view of an example electrical connection system for an electronic device.
Figure 26:
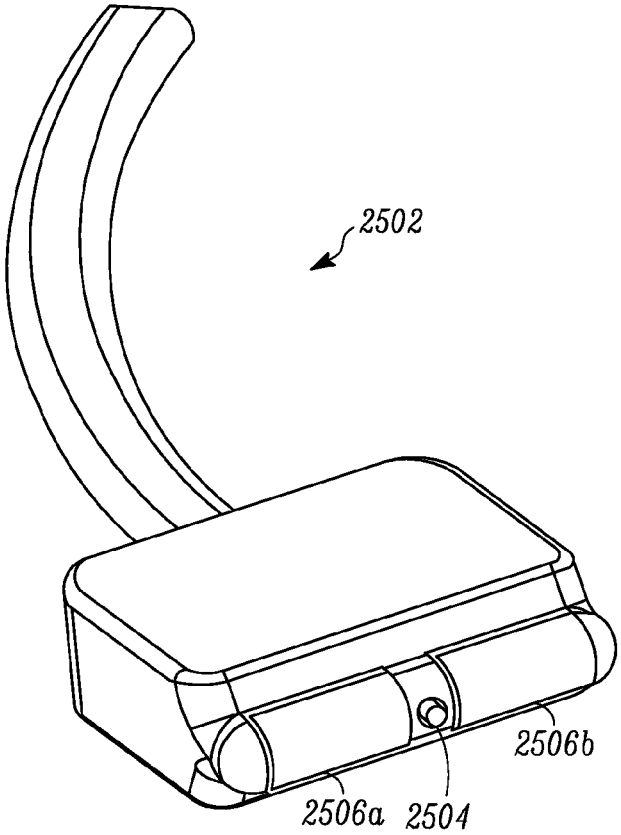
FIG. 26 is a partial perspective view of an electrical connector of the system of FIG. 25.
Figure 27:
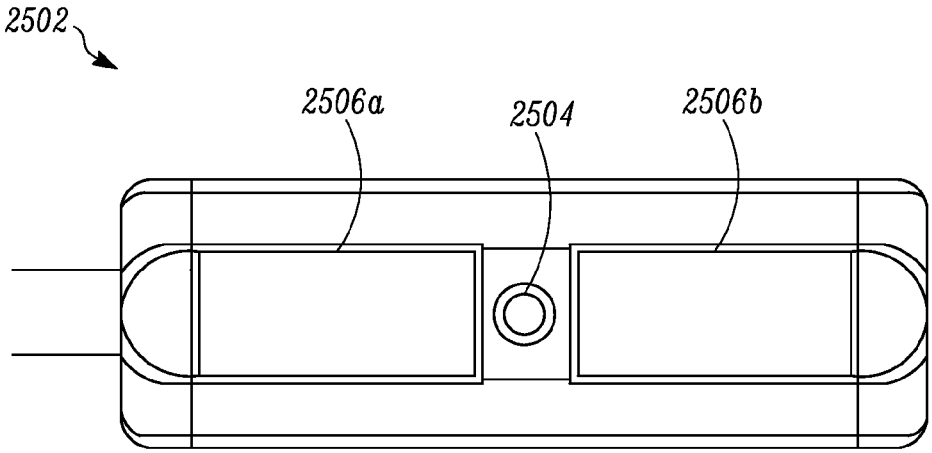
FIG. 27 is a partial front view of the electrical connector of the system of FIG. 25.
Figure 28:
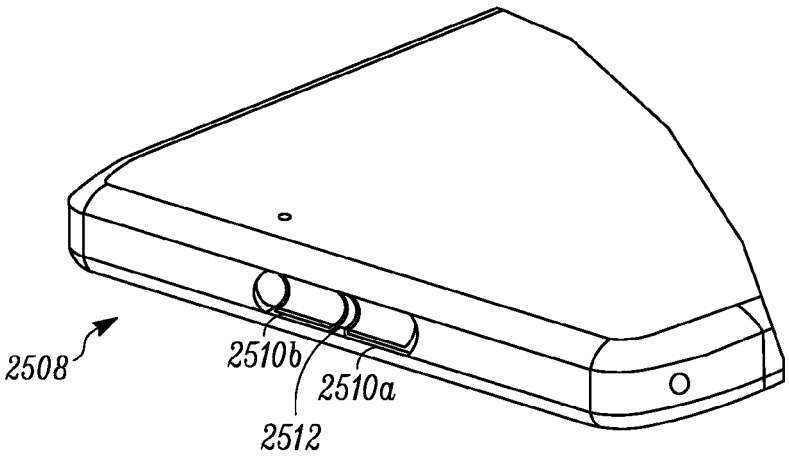
FIG. 28 is a partial perspective view of the electronic device and the electrical receptacle of the system of FIG. 25.
Figure 29:
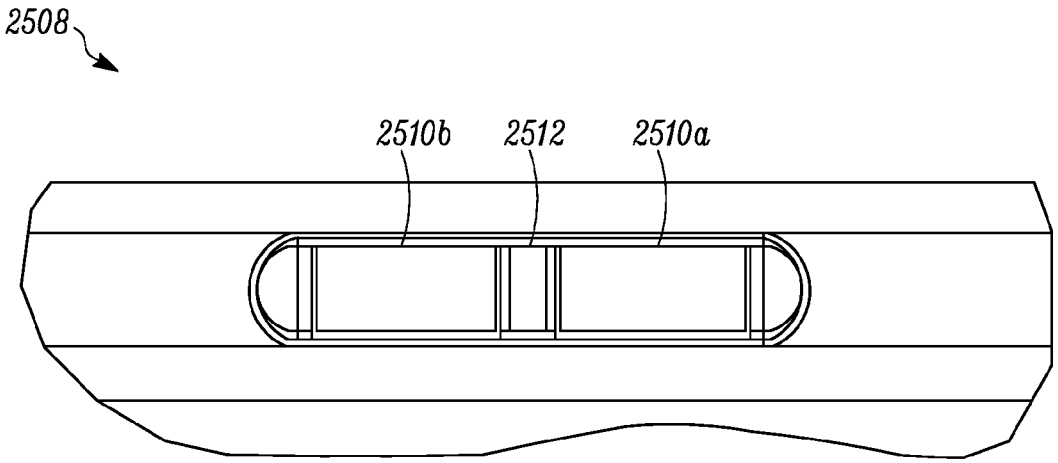
FIG. 29 is a partial front view of the electronic device and the electrical receptacle of the system of FIG. 25.

FIG. 24 illustrates an embodiment of a male electrical connector 2400 in which the features and components are substantially as described in the previous paragraph. However, the electrical connector 2400 includes a first magnet 2402*a* that mounts a first electrical insulator 2404*a*. The first insulator 2404*a* includes a first passageway 2406*a* that receives a first resilient electrical contact 2408*a*. The electrical connector 2400 also includes a second magnet 2402*b* that mounts a second electrical insulator 2404*b*. The second insulator 2404*b* includes a second passageway 2406*b* that receives a second resilient electrical contact 2408*b*. The electrical connector 2400 further includes a third resilient electrical contact 2408*c* that is disposed between the first magnet 2402*a* and the second magnet 2402*b*. A female electrical receptacle used with the male electrical connector 2400 may include curved ferrous contacts and curved electrical contacts disposed to abut with the magnets and resilient electrical contacts, respectively.

FIGS. 25-29 illustrate an embodiment of an electrical connection system 2500 in which the features and components are substantially as described above. However, the male electrical connector 2502 only includes a single resilient electrical contact 2504, which is disposed between a first magnet 2506*a* and a second magnet 2506*b*. The female electrical receptacle 2508 used with the male electrical connector 2502 may include curved ferrous contact 2510*a* and 2510*b* and a curved electrical contact 2512 disposed to abut with the magnets 2506*a* and 2506*b* and the resilient electrical contact 2504, respectively. In some embodiments, the electrical connection system 2500 facilitates only power transmission. In such embodiments, the resilient electrical contact 2504 facilitates power transmission and the magnets 2506*a* and 2506*b* act as grounding contacts. Further, in such embodiments, the male electrical connector 2502 may be reversibly connectable to the female electrical receptacle 2508 (that is, the male electrical connector 2502 may be decoupled from the female electrical receptacle 2508, rotated 180 degrees about the longitudinal axis of the resilient electrical contact 2504, and recoupled to the female electrical receptacle 2508).

Figure 30:
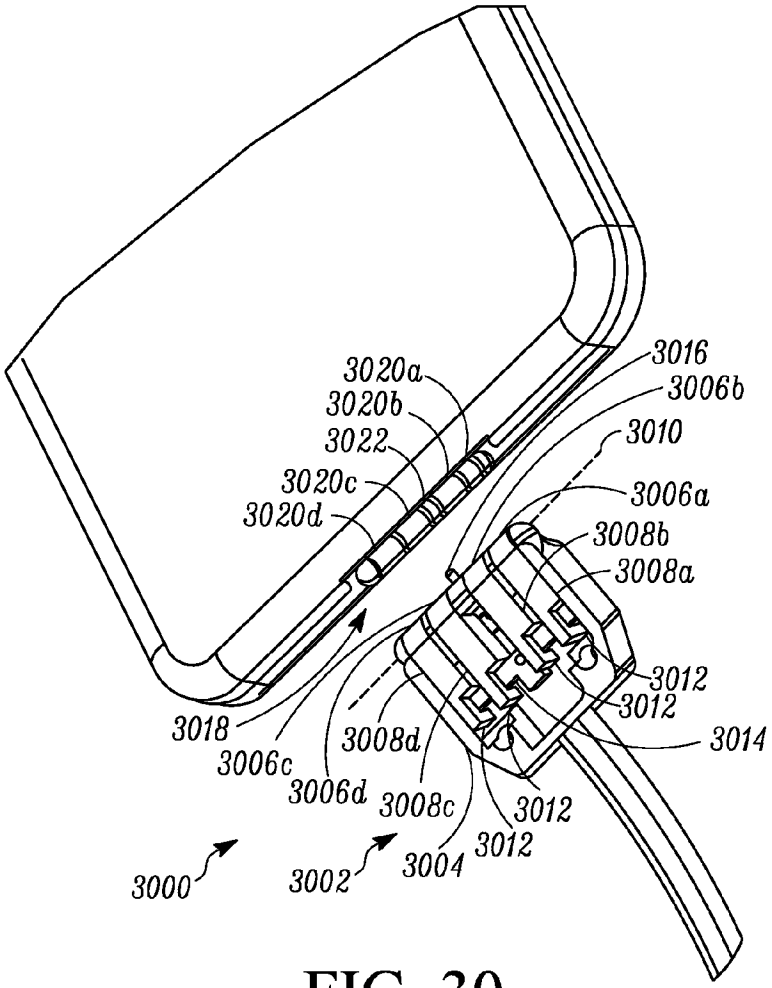
FIG. 30 is a partial perspective view of an example electrical connection system for an electronic device with a connector cover hidden for illustrative purposes.
Figure 31:
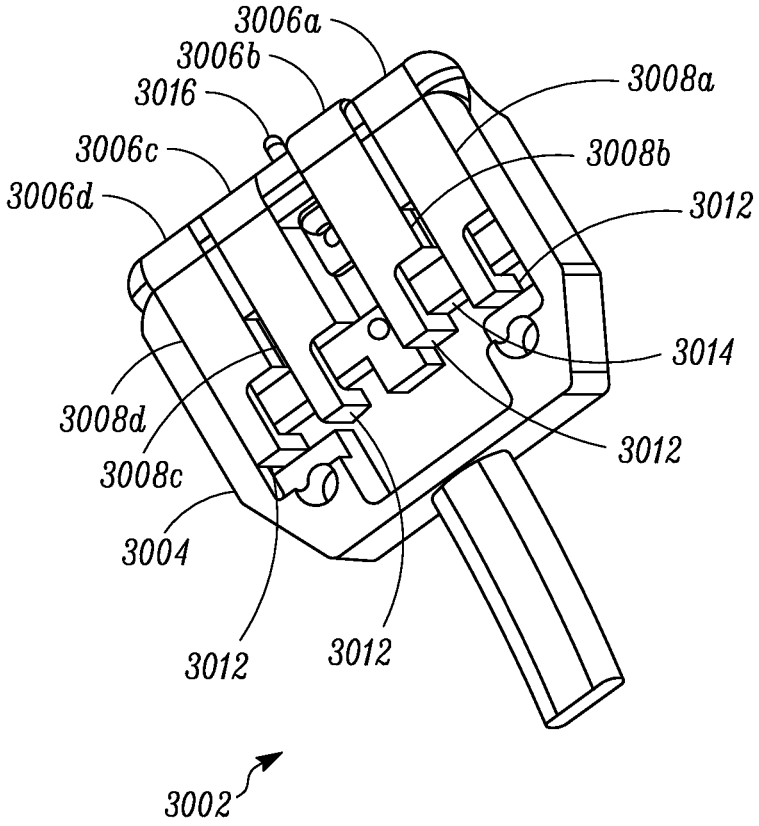
FIG. 31 is a partial perspective view of the electrical connector of the system of FIG. 30 with the connector cover hidden for illustrative purposes.
Figure 32:
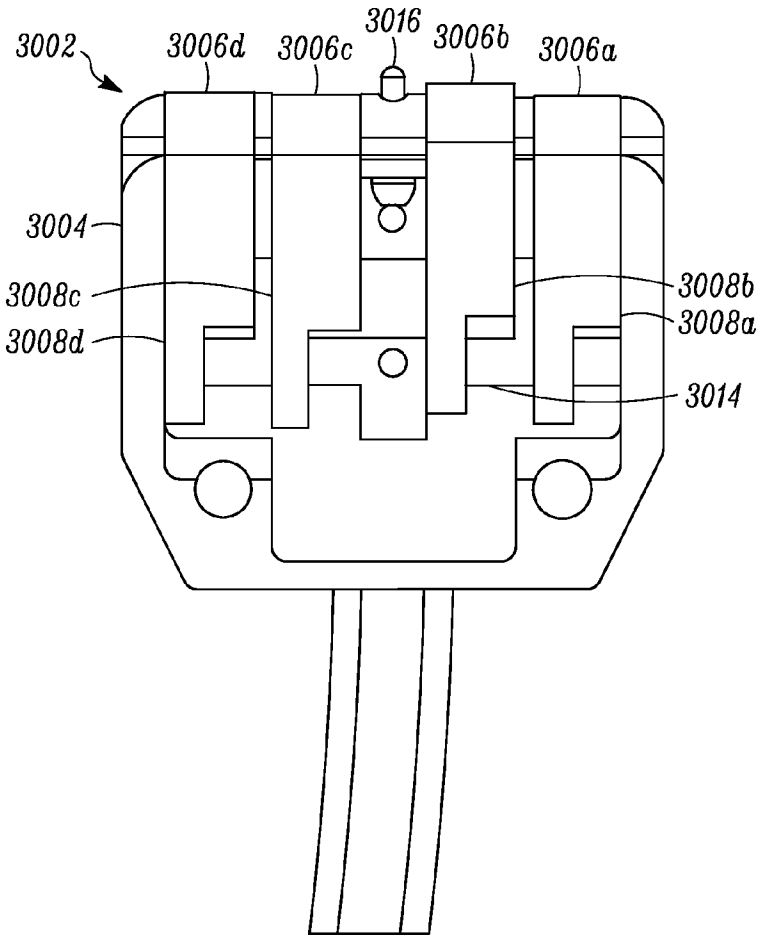
FIG. 32 is a partial top view of the electrical connector of the system of FIG. 30 with the connector cover hidden for illustrative purposes.

In some embodiments, for example, those in which the male electrical connector includes three or more electrically conductive magnets, the magnets may be movably supported to facilitate contact with the appropriate ferrous contact. FIGS. 30-32 illustrate an embodiment of an electrical connection system 3000 that includes such magnets. Many of the features and components of the electrical connection system 3000 are similar to those described above. However, the male electrical connector 3002 includes a connector housing 3004 that movably mounts a first magnet 3006*a*, a second magnet 3006*b*, a third magnet 3006*c*, and a fourth magnet 3006*d*. The magnets 3006*a*, 3006*b*, 3006*c*, and 3006*d* are fixedly supported by internal magnet supports 3008*a*, 3008*b*, 3008*c*, and 3008*d*, respectively, in any of various manners, such as via an adhesive or the like. The magnet supports 3008*a*, 3008*b*, 3008*c*, and 3008*d* are movable in an engagement direction relative to the connector housing 3004. The engagement direction may bisect the magnets 3006*a*, 3006*b*, 3006*c*, and 3006*d* and be substantially perpendicular to the articulation axis 3010. The magnets 3006*a*, 3006*b*, 3006*c*, and 3006*d* and/or the magnet supports 3008*a*, 3008*b*, 3008*c*, and 3008*d* may include various features to limit the range of motion of the magnets 3006*a*, 3006*b*, 3006*c*, and 3006*d* and inhibit detachment from the connector housing 3004. For example, each magnet support 3008*a*, 3008*b*, 3008*c*, and 3008*d* may include a downwardly-extending leg 3012 that engages a protrusion 3014 of the connector housing 3004. The electrical connector 3002 also includes a single resilient electrical contact 3016 disposed between the second and third magnets 3006*b* and 3006*c*. A female electrical receptacle 3018 used with the male electrical connector 3002 may include curved ferrous contacts 3020*a*, 3020*b*, 3020*c*, and 3020*d* and a single curved electrical contact 3022 disposed to abut with the magnets 3006*a*, 3006*b*, 3006*c*, and 3006*d* and the resilient electrical contact 3016, respectively.

Various other alternatives and modifications to the electrical connection systems described above are also contemplated. For example, the magnet or magnets may be coated with an electrically insulating material (such as a polymer or the like), or the magnet or magnets may be separated from the ferrous contacts by a portion of the connector housing (specifically a portion including a curved or cylindrical contact surface for abutment with the female electrical receptacle). In some such embodiments, the magnet or magnets may lack curved surfaces. As another example, the resilient electrical contacts could be carried by the female electrical receptacle and the electrical contacts could be carried by the male electrical connector.

In summary, persons of ordinary skill in the art will readily appreciate that various embodiments of electrical connection systems for electronic devices have been provided. Such electrical connection systems provide relatively high magnetic attraction forces between the electrical connector and electrical receptacle. Further, such electrical connection systems facilitate articulation of the electrical connector relative to the electrical receptacle.

The foregoing description has been presented for the purposes of illustration and description. It is not intended to be exhaustive or to limit the disclosure to the exemplary embodiments described above. Many modifications and variations are possible in light of the above teachings. It is intended that the scope of this disclosure be limited not by this detailed description of examples, but rather by the claims appended hereto.

What is claimed is:

1. A male electrical connector comprising:

a male housing portion;

at least a first magnet carried by said male housing portion, said first magnet comprising a curved contact surface configured to abut with an inwardly curved contact surface of a substantially cylindrically shaped first ferrous contact included in a female electrical receptacle, the inwardly curved contact surface not having a ground material interfering with the abutting with the inwardly curved contact surface; and at least a first resilient electrical contact carried by said male housing portion for making an electrical connection by abutting with a curved contact surface of a substantially cylindrically shaped first electrical contact included in the female electrical receptacle;

wherein said first magnet and said first resilient electrical contact are disposed in a parallel configuration along a transverse axis of said male housing portion, and wherein said first ferrous contact and said first electrical contact are disposed in a parallel configuration along a transverse axis of said female electrical receptacle; and wherein the male electrical connector is configured to maintain the electrical connection between the first resilient electrical contact carried by said male housing portion and the first electrical contact included in the female electrical receptacle while the male housing portion pivots with respect to the female electrical receptacle.

2. The electrical connector of claim 1, wherein said curved contact surface is electrically conductive.

3. The electrical connector of claim 1, wherein said curved contact surface of said first magnet is substantially cylindrical.

4. The electrical connector of claim 1, wherein said curved contact surface of said first magnet is convex.

5. The electrical connector of claim 1, wherein said first resilient electrical contact projects outwardly beyond said curved contact surface of said first magnet.

6. The electrical connector of claim 1, further comprising a resilient element carried by said male housing portion and biasing said first resilient electrical contact outwardly with respect to said male housing portion.

7. The electrical connector of claim 1, further comprising a shunt carried by said male housing portion, the shunt being configured to modify a magnetic field of said first magnet.

8. The electrical connector of claim 7, further comprising an insulator carried by said male housing portion and insulating said first magnet from said shunt.

9. The electrical connector of claim 1, further comprising:

a second magnet carried by said male housing portion, said second magnet comprising a curved contact surface configured to abut with a curved contact surface of a substantially cylindrically shaped second ferrous contact included in the female electrical receptacle, and wherein said first resilient electrical contact is disposed between said first magnet and said second magnet.

10. The electrical connector of claim 9, further comprising:

a second resilient electrical contact carried by said male housing portion for making an electrical connection by abutting with a curved contact surface of a substantially cylindrically shaped second electrical contact included in the female electrical receptacle; and wherein said first resilient electrical contact and said second resilient electrical contact are disposed between said first magnet and said second magnet.

11. The electrical connector of claim 9, further comprising:

a second resilient electrical contact carried by said male housing portion for making an electrical connection by abutting with a curved contact surface of a substantially cylindrically shaped second electrical contact included in the female electrical receptacle;

a third resilient electrical contact carried by said male housing portion for making an electrical connection by abutting with a curved contact surface of a substantially cylindrically shaped third electrical contact included in the female electrical receptacle; and wherein said first magnet is disposed between said first resilient electrical contact and said second resilient electrical contact, said second resilient electrical contact is disposed between said first magnet and said second magnet, and said second magnet is disposed between said second resilient electrical contact and said third resilient electrical contact.

12. The electrical connector of claim 1, further comprising:

a second magnet carried by said male housing portion, said second magnet comprising a curved contact surface configured to abut with a curved contact surface of a substantially cylindrically shaped second ferrous contact included in the female electrical receptacle;

a third magnet carried by said male housing portion, said third magnet comprising a curved contact surface configured to abut with a curved contact surface of a substantially cylindrically shaped third ferrous contact included in the female electrical receptacle;

a fourth magnet carried by said male housing portion, said fourth magnet comprising a curved contact surface configured to abut with a curved contact surface of a substantially cylindrically shaped fourth ferrous contact included in the female electrical receptacle; and wherein said second magnet is disposed between said first magnet and said first resilient electrical contact, said first resilient electrical contact is disposed between said second magnet and said third magnet, and said third magnet is disposed between said first resilient electrical contact and said fourth magnet.

13. The electrical connector of claim 1, further comprising:

a second resilient electrical contact carried by said male housing portion for making an electrical connection by abutting with a curved contact surface of a substantially cylindrically shaped second electrical contact included in the female electrical receptacle;

a third resilient electrical contact carried by said male housing portion for making an electrical connection by abutting with a curved contact surface of a substantially cylindrically shaped third electrical contact included in the female electrical receptacle;

a fourth resilient electrical contact carried by said male housing portion for making an electrical connection by abutting with a curved contact surface of a substantially cylindrically shaped fourth electrical contact included in the female electrical receptacle; and wherein said second resilient electrical contact is disposed between said first resilient electrical contact and said first magnet, said first magnet is disposed between said second resilient electrical contact and said third resilient electrical contact, and said third resilient electrical contact is disposed between said first magnet and said fourth resilient electrical contact.

14. The electrical connector of claim 1, further comprising a first insulator extending through said first magnet and mounting said first resilient electrical contact.

15. The electrical connector of claim 14, further comprising:

a second magnet carried by said male housing portion, said second magnet comprising a curved contact surface configured to abut with a curved contact surface of a substantially cylindrically shaped second ferrous contact included in the female electrical receptacle;

a second resilient electrical contact carried by said male housing portion for making an electrical connection by abutting with a curved contact surface of a substantially cylindrically shaped second electrical contact included in the female electrical receptacle;

a second insulator extending through said second magnet and mounting said second resilient electrical contact; and a third resilient electrical contact carried by said male housing portion for making an electrical connection by abutting with a curved contact surface of a substantially cylindrically shaped third electrical contact included in female electrical receptacle, said third resilient electrical contact being disposed between said first magnet and said second magnet.

16. An electrical receptacle comprising:

a female housing portion;

at least a first ferrous contact carried by said female housing portion, said first ferrous contact comprising an inwardly curved contact surface configured to abut with a first magnet included in a male electrical connector;

at least a first electrical contact carried by said female housing portion, said first electrical contact comprising a curved contact surface for making an electrical connection by abutting with a first resilient electrical contact included in the male electrical connector; and a shunt electrically insulated from the first ferrous contact and the first electrical contact;

wherein said first ferrous contact and said first electrical contact are disposed in a parallel configuration along a transverse axis of said female housing portion, wherein said first magnet and said first resilient electrical contact are disposed in a parallel configuration along a transverse axis of said male electrical connector; and wherein the electrical receptacle is configured to maintain the electrical connection between the first electrical contact carried by said female housing portion and the first resilient electrical contact included in the male electrical connector while the male electrical connector pivots with respect to the female housing portion.

17. The electrical receptacle of claim 16, wherein said first ferrous contact is electrically conductive.

18. The electrical receptacle of claim 16, wherein said inwardly curved contact surface of said first ferrous contact is substantially cylindrical.

19. The electrical receptacle of claim 16, wherein said first resilient electrical contact included in the male electrical connector projects outwardly beyond a contact surface of said male electrical connector.

20. The electrical receptacle of claim 16, further comprising:

a second ferrous contact carried by said female housing portion, the second ferrous contact comprising an inwardly curved contact surface configured to abut with a second magnet included in the male electrical connector, and wherein said first electrical contact is disposed between said first ferrous contact and said second ferrous contact.

21. The electrical receptacle of claim 20, wherein said second ferrous contact is electrically conductive.

22. An electrical connection system comprising:

a connector including a male housing portion;

at least a first magnet carried by said male housing portion, said first magnet comprising a curved contact surface;

a receptacle configured to engage said connector and including:

a female housing portion; and at least a first ferrous contact carried by said female housing portion, said first ferrous contact comprising a substantially cylindrically shaped curved contact surface configured to abut with said curved contact surface of said first magnet, said substantially cylindrically shaped curved contact surface of said first ferrous contact not having a ground material interfering with the abutting with said curved contact surface of said first magnet;

at least a first resilient electrical contact carried by one of said male housing portion and said female housing portion; and at least a second electrical contact carried by said other of said male housing portion and said female housing portion, and said first electrical contact comprising a substantially cylindrically shaped inwardly curved contact surface for making an electrical connection by abutting with said first resilient electrical contact;

wherein said first magnet and said first resilient electrical contact are disposed in a parallel configuration along a transverse axis of said electrical connection system, and wherein said first ferrous contact and said first electrical contact are disposed in a parallel configuration along a transverse axis of said electrical connection system; and wherein the connector is configured to maintain the electrical connection between the electrical contacts of said male housing portion and said female housing portion while the male housing portion pivots with respect to the female housing portion.

23. The electrical connection system of claim 22, wherein said curved contact surface of said first magnet is electrically conductive and said curved contact surface of said first ferrous contact is electrically conductive.

24. The electrical connection system of claim 22, wherein said curved contact surface of said first magnet is substantially cylindrical.

25. The electrical connection system of claim 22, further comprising a second magnet carried by said male housing portion and comprising a curved contact surface, and wherein said first resilient electrical contact is disposed between said first magnet and said second magnet.

26. The electrical connection system of claim 22, wherein a longitudinal axis of the substantially cylindrically shaped inwardly curved contact surface of the first ferrous contact and a longitudinal axis of the substantially cylindrically shaped inwardly curved contact surface of the second electrical contact are aligned with an articulation axis, said male housing portion being articulatable about the articulation axis and relative to said female housing portion when said connector is engaged with said receptacle.

27. An electrical connector comprising:

a male housing portion having a substantially cylindrical magnetic contact surface configured to abut with a substantially cylindrical inwardly curved contact surface of a female electrical receptacle, the substantially cylindrical magnetic contact surface being configured to interconnect with said substantially cylindrical inwardly curved contact surface of the female electrical receptacle and hold a first resilient electrical contact interconnected with a female electrical receptacle; and the first resilient electrical contact carried by said male housing portion for making an electrical connection with the female electrical receptacle, wherein the electrical connector is configured to maintain the electrical connection between the first resilient electrical contact carried by said male housing portion and the female electrical receptacle while the male housing portion pivots with respect to the female electrical receptacle.

28. The electrical connector of claim 27, wherein:

the substantially cylindrical magnetic contact surface comprises a first substantially cylindrical magnetic contact surface; and the electrical connector further comprises a second substantially cylindrical magnetic contact surface carried by said male housing portion, said second substantially cylindrical magnetic contact surface being configured to hold said substantially cylindrical magnetic contact surface of said male housing portion interconnected with said substantially cylindrical inwardly curved contact surface of the female electrical receptacle and hold said first resilient electrical contact interconnected with the female electrical receptacle.

29. The electrical connector of claim 28, further comprising:

a second resilient electrical contact carried by said male housing portion for making an electrical connection with the female electrical receptacle;

wherein said first resilient electrical contact and said second resilient electrical contact are disposed between said first substantially cylindrical magnetic contact surface and said second substantially cylindrical magnetic contact surface.

30. The electrical connector of claim 27, wherein said first resilient electrical contact projects outwardly beyond said substantially cylindrical magnetic contact surface of said male housing portion.

31. An electronic device comprising:

a device housing;

electronic circuitry carried by said device housing; and a receptacle including:

a female housing portion coupled to said device housing;

at least a first ferrous contact carried by said female housing portion, and said first ferrous contact comprising a substantially cylindrically shaped inwardly curved contact surface configured to abut with a male electrical connector, the substantially cylindrically shaped inwardly curved contact surface not having a ground material interfering with the abutting with the male electrical connector; and at least a first electrical contact carried by said female housing portion and electrically coupled to said electronic circuitry, and said first electrical contact comprising a substantially cylindrically shaped outwardly curved contact surface for making an electrical connection with the male electrical connector, wherein the receptacle is configured to maintain the electrical connection between the first electrical contact carried by said female housing portion and the male electrical connector while the male electrical connector pivots with respect to the female housing portion.

32. The electronic device of claim 31, wherein said first ferrous contact is electrically conductive and electrically coupled to said electronic circuitry.

33. The electronic device of claim 31, wherein said substantially cylindrically shaped curved contact surface of said first ferrous contact has a substantially constant radius.

34. The electronic device of claim 31, wherein said first electrical contact makes the electrical connection by abutting with a first resilient electrical contact included in the male electrical connector, the first resilient electrical contact projecting outwardly beyond a contact surface of said male electrical connector.

* * * * *